US005432296A

United States Patent [19]

Takeuchi et al.

[11] Patent Number: 5,432,296

[45] Date of Patent: Jul. 11, 1995

[54] MUSICAL TONE SYNTHESIZING APPARATUS UTILIZING AN ALL-PASS FILTER HAVING A VARIABLE FRACTIONAL DELAY

[75] Inventors: Chifumi Takeuchi, Hamamatsu; Iwao Higashi, Shimonoseki, both of Japan

[73] Assignee: Yamaha Corporation, Japan

[21] Appl. No.: 108,993

[22] Filed: Aug. 18, 1993

[30] Foreign Application Priority Data

Aug. 20, 1992 [JP] Japan ..... 4-221826

[51] Int. Cl.[6] ..... G10H 1/12

[52] U.S. Cl. ..... 84/661; 84/DIG. 9; 84/DIG. 10

[58] Field of Search ..... 84/659-661, 84/699, 700, 736, DIG. 9, DIG. 10

[56] References Cited

U.S. PATENT DOCUMENTS 5,136,917 8/1992 Kunimoto .

5,223,656 6/1993 Higashi ..... 84/661

OTHER PUBLICATIONS

"Extensions of the Karplus-Strong Plucked-String Algorithm", David A. Jaffe, Julius O. Smith, Computer Music Journal, vol. 7, No. 2, Summer 1983, pp. 56-69.

*Primary Examiner*—Stanley J. Witkowski

*Attorney, Agent, or Firm*—Graham & James

[57] ABSTRACT

The musical tone synthesizing apparatus is mainly configured by a closed loop which at least provides a delay circuit and an all-pass filter. The delay circuit delays an input signal (e.g., excitation wave signal) by a first delay time corresponding to a certain integral number of sampling periods. The all-pass filter functions to at least delay an output of the delay circuit by a second delay time corresponding to a decimal fraction of the sampling period, so that an output of the all-pass filter is fed back to the delay circuit. The whole delay time of the closed loop consists of the first and second delay times which can be respectively controlled. Thus, a musical tone signal representing a synthesized musical tone (e.g., an attenuating sound which is produced from an percussion instrument) is picked up from the closed loop. Incidentally, the whole configuration of the closed loop can be embodied by a digital signal processor (DSP).

19 Claims, 15 Drawing Sheets

MUSICAL TONE SYNTHESIZING APPARATUS UTILIZING AN ALL-PASS FILTER HAVING A VARIABLE FRACTIONAL DELAY

BACKGROUND OF THE INVENTION

1. Field of the Invention

The present invention relates to a musical tone synthesizing apparatus which is suitable for synthesizing musical tones produced from percussion instruments.

2. Prior Art

Recently, several kinds of musical tone synthesizing apparatuses are developed such that by activating a simulation model simulating a tone-generation mechanism of the non-electronic musical instrument, the musical tones of the non-electronic musical instrument can be simulated well. Some of these musical tone synthesizing apparatuses are designed to synthesize percussive sounds produced from the percussion instruments. General characteristic of the percussive sounds is inability to sustain sounds, in other words, the percussive sound is rapidly attenuated in tone volume. Hereinafter, the percussive sound having the above-mentioned characteristic will be referred to as "an attenuating sound". As the circuitry to synthesize the attenuating sound, a closed-loop circuitry which contains an adder 1, a delay circuit 2 and a filter 3 as shown in FIG. 17 is known. This type of circuitry is designed on the basis of a so-called delay-feedback-type circuitry.

The delay circuit 2 is configured by a shift register. The shift register provides plural flip-flops of which number (simply referred to as a stage number) is determined responsive to a number of bits of a digital signal which is supplied to the delay circuit 2 from the adder 1. Each of the flip-flop receives a clock which is produced by each sampling period $\tau_s$. A delay time $\tau_p$ of the delay circuit 2 is equivalent to a result of multiplication in which the sampling period $\tau$ is multiplied by a stage number N of the shift register, i.e., "$N\tau_s$". The filter 3 imparts a desired attenuation characteristic to a signal which circulates through the closed loop.

Meanwhile, an analog signal containing frequency components like a noise signal is modulated by a PCM (i.e., Pulse Code Modulation) technique by each sampling period $\tau_s$, resulting that a time-series digital signal is obtained. Such time-series digital signal is applied to the musical tone synthesizing apparatus as its input signal. This input signal is supplied to the adder 1, from which it is supplied to the filter 3 by means of the delay circuit 2. Then, the signal is fed back to the adder 1. Thus, the input signal circulates through the closed loop.

When ignoring a phase delay occurring in the filter 3, a time which is required for the input signal to circulate the closed loop once is assumed to be equal to the delay time $\tau_p$. In this case, the gain of the closed loop has a frequency characteristic of which maximum point is emerged at an integral multiple of a fundamental frequency $f1=1/\tau_p$. Since the closed-loop gain is slightly smaller than "1", the signal which repeatedly circulates through the closed loop is gradually attenuated in amplitude. During an attenuating process of the signal, the output of the adder 1 is extracted and is subjected to digital-to-analog conversion. Thus, it is possible to obtain an attenuating signal having a fundamental wave and the other higher harmonic waves of which frequencies correspond to integral multiples of the fundamental frequency. By use of the above-mentioned closed loop, it is possible to excite the musical tone signal having the fundamental-wave component and higher-harmonic components like the real musical sound which is produced from the stringed instrument. Such musical tone signal is gradually attenuated in amplitude in a lapse of time.

In the circuitry shown in FIG. 17, the delay time $\tau$ can be set in response to the integral multiple of the sampling period $\tau$, in other words, the delay time $\tau$ cannot be arbitrarily changed other than the delay times each corresponding to the integral multiple of the sampling period. In order to obtain an arbitrary delay time which is shifted from the delay time corresponding to the integral multiple of the sampling period $\tau_s$, an all-pass filter 4 must be inserted between the delay circuit 2 and the filter 3 as shown in FIG. 18. This all-pass filter 4 is designed on tile basis of the known configuration of the primary digital filter. It is configured by adders 41, 42, multipliers 43, 44 and a delay circuit 45. As similar to the delay circuit 2, the delay circuit 45 receives a clock by each sampling period $\tau_s$.

In the all-pass filter 4, the output of the delay circuit 2 is added with an output of the multiplier 44 by the adder 41. The output of the adder 41 is delivered to the adder 42 by means of the delay circuit 45. In addition, the output of the adder 41 is also delivered to the multiplier 43 wherein it is multiplied by a multiplication coefficient "$-\alpha$". Then, a result of the multiplication performed by the multiplier 43 is supplied to the adder 42. On the other hand, the multiplier 44 multiplies the output of the delay circuit 45 by a multiplication coefficient "$\alpha$", and then, a result of the multiplication performed by the multiplier 44 is supplied to the adder 41. The adder 42 adds the output of the delay circuit 45 to the output of the multiplier 43. A result of the addition is outputted to the filter 3. As each of the multiplication coefficients "$\alpha$" and "$-\alpha$" which are respectively used in the multipliers 43 and 44, it is possible to use a value which exists between "$-1$" and "1".

The function of the all-pass filter 4 described above can be expressed by use of a transfer function H(z) which is denoted by an equation (1) as follows:

$$H(z)=\alpha+z^{-1}/1+\alpha z^{-1} \quad (1)$$

By replacing the term "z" by another term "$\exp(-j\omega\tau_s)$" in the equation (1), it is possible to obtain an equation (2), which represents a frequency characteristic $F(\omega)$ of the all-pass filter 4.

$$F(\omega)=\alpha+exp(-j\omega\tau_s)/1+\alpha^*\exp(^{\prime}j\omega\tau_s) \quad (2)$$

A gain-frequency characteristic $G(\omega)$ of the all-pass filter 4 becomes equal to an absolute value of the above-described equation (2) as follows:

$$G(\omega)=|F(\omega)|=1.$$

Thus, the gain of the all-pass filter 4 is maintained at "1" in all of the frequency bands. This is the reason why this type of filter is called as the all-pass filter. Under the condition where an angular frequency $\omega$ is relatively low as compared to the Nyquist's angular frequency $\omega n=2\pi fs/2$ (where fs is the sampling frequency) and a phase angle $\omega\tau_s$ is close to "0", a phase delay $P(\omega)$ can be expressed by the following approximate expression (3).

$$P(\omega) \doteqdot (1-\alpha)\omega\tau_s/(1+\alpha) \quad (3)$$

An equivalent delay time $\tau_a$ of the all-pass filter 4 is expressed by the following equation (4).

$$\tau_a = P(\omega)/\omega \quad (4)$$

By use of the aforementioned equation (3), the delay time $\tau_a$ can be approximated as follows:

$$\tau_a \doteqdot (1-\alpha)\tau_s/(1+\alpha).$$

This approximate expression indicates that the delay time $\tau_a$ of the all-pass filter 4 can be adjusted by changing the multiplication coefficient $\alpha$.

In result, the closed loop which consists of the circuit elements 1 to 4 as shown in FIG. 18 may have a resonance characteristic which responds to a whole delay time $\tau$ (where $\tau=\tau_p+\tau_a$). Next, the resonance characteristic of the closed loop will be described by referring to FIGS. 19(A) to 19(C). FIG. 19(A) shows a relationship between a frequency f and a phase delay $\theta$ in connection with the delay circuit 2 (see FIG. 18). As shown in FIG. 19(A), when the frequency f of the signal passing through the delay circuit 2 becomes equal to f1 (where $f1=1/\tau_p$), the phase difference $\theta$ existing between the phases of the input signal and output signal of the delay circuit 2 becomes equal to $2\pi$. The phase difference $\theta$ turns to $4\pi$ when the frequency f is equal to f2 which is twice as large as the frequency f1, while the phase difference $\theta$ turns to $6\pi$ when the frequency f is equal to f3 which is a triple of the frequency f1. In short, the phase delay $\theta$ is linearly changed with respect to the frequency f as shown by a straight line A shown in FIG. 19(A). When the frequency f becomes equal to the integral multiple of the fundamental frequency, the phase of the input signal coincides with that of the output signal.

FIG. 19(B) shows a relationship between the frequency f and the phase delay $\theta$ in the all-pass filter 4. According to the aforementioned equation (3), the phase delay $\theta$ is approximately varied along with a linear curve with respect to the frequency f under the condition where the frequency f is sufficiently lower than the Nyquist's frequency $\frac{1}{2}\tau_s$. However, when varying the frequency f in a wide range including the Nyquist's frequency $\frac{1}{2}\tau_s$, the phase delay $\theta$ is varied along with a curve B shown in FIG. 19(B).

Therefore, a resonant frequency of the musical tone synthesizing apparatus is changed responsive to the whole phase delay of the closed loop which is obtained by adding the phase delay of the delay circuit 2 (see FIG. 19(A)) with the phase delay of the all-pass filter 4 (see FIG. 19(B)). FIG. 19(C) is a graph showing a delay characteristic of the closed loop as a whole (see a curve C). Due to the insertion of the all-pass filter 4 into the closed loop, the phase delay $\theta$ becomes equal to $2\pi$, $4\pi$, $6\pi$ at respective frequencies f1a, f2a, f3a which are respectively shifted from the aforementioned frequencies f1, f2, f3.

In the case where the frequency f of the signal coincides with each of the frequencies f1a, f2a, f3a, . . . , the phase of the signal is not changed at all even if the signal circulates the closed loop once. At these frequencies, the gain of the closed loop becomes maximum, in other words, the closed loop is set in a resonating state. Since a non-linear relationship is established between the frequency f and the phase delay $\theta$, an interval between adjacent two of the frequencies f1a, f2a, f3a, . . . cannot be maintained constant. Thus, the insertion of the all-pass filter 4 enables the closed loop to synthesize the musical tones having an overtone structure. In the overtone structure, higher harmonics of which frequencies are not equal to the integral multiple of the fundamental frequency are contained in the musical tone. As described before, by changing the multiplication coefficient $\alpha$, the resonant frequency of the closed loop can be changed, resulting that the tone pitch of the attenuating sound corresponding to the signal circulating through the closed loop can be controlled. As another method to control the tone pitch of the musical tone to be synthesized by the musical tone synthesizing apparatus, it is possible to employ a weighted interpolation which is effected on each of the delay stages of the delay circuit 2 so as to control the delay time $\tau_p$.

As described above, the conventional musical tone synthesizing apparatus can control the tone pitch in response to a variation of the delay amount of the closed loop which is carried out by changing the multiplication coefficient $\alpha$ of the all-pass filter 4. However, this type of the musical tone synthesizing apparatus suffers from the following drawbacks. When largely changing the multiplication coefficient $\alpha$ of the all-pass filter 4, the whole delay amount of the closed loop must be largely varied. In that case, the apparatus synthesizes a non-harmonious musical tone containing a plenty of higher harmonics of which number is larger than the necessary number of the higher harmonics. As a result, this type of the musical tone synthesizing apparatus is not suitable for the electronic musical instrument. A control of the delay amount which is controlled by changing the multiplication coefficient $\alpha$ of the all-pass filter 4 is effective only when the delay circuit 2 provides one or two delay stages. Further, when changing the multiplication coefficient $\alpha$ while also changing the number of the delay stages of the delay circuit 2, the multiplication coefficient $\alpha$ should be changed discontinuously, which may cause a production of noises.

In another type of the apparatus in which the weighted interpolation is effected on each of the delay stages of the delay circuit 2 so as to control the delay time $\tau_p$, the tone pitch can be controlled in a relatively wide range. However, the interpolation of the delay stages causes an operation of a low-pass filter, which deteriorates the frequency characteristic of the musical tone to be synthesized. In addition, this type of the apparatus also suffers from a disadvantage in that an attenuation time of the attenuating sound must be changed responsive to the control of the tone pitch. In short, the conventional musical tone synthesizing apparatus providing the all-pass filter 4 cannot alter the delay amount smoothly without causing a variation of the amplitude of the musical tone. In other words, the conventional apparatus suffers from a problem in that the tone pitch of the attenuating sound cannot be controlled to be altered continuously.

SUMMARY OF THE INVENTION

It is accordingly a primary object of the present invention to provide a musical tone synthesizing apparatus which can control the tone pitch of the attenuating sound to be altered continuously.

The musical tone synthesizing apparatus according to the present invention is mainly configured by a closed loop which at least provides a first delay portion and a second delay portion. The first delay portion delays an input signal (e.g., excitation wave signal) by a first delay time corresponding to a certain integral number of sampling periods. The second delay portion receives an output of the first delay portion so as to delay it by a second delay time corresponding to a decimal fraction of the sampling period, so that an output of the second delay portion is fed back to the first delay portion.

The closed loop has a whole delay time consisting of an integral-part delay time and a decimal-part delay time. Herein, the integral-part delay time corresponds to the first delay time, while the decimal-part delay time corresponds to the second delay time. Thus, a musical tone signal representing a synthesized musical tone (or the attenuating sound) is picked up from the closed loop. Incidentally, an all-pass filter which acts upon a filter coefficient supplied thereto can be employed as the second delay portion, whereas the whole configuration of the closed loop can be embodied by a digital signal processor.

By controlling the first and second delay times respectively, it is possible to perform a fine control on the whole delay time of the closed loop. Thus, the tone pitch of the musical tone to be produced can be smoothly and continuously controlled without causing the noises.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENT

[A] Whole Configuration

Figure 1:
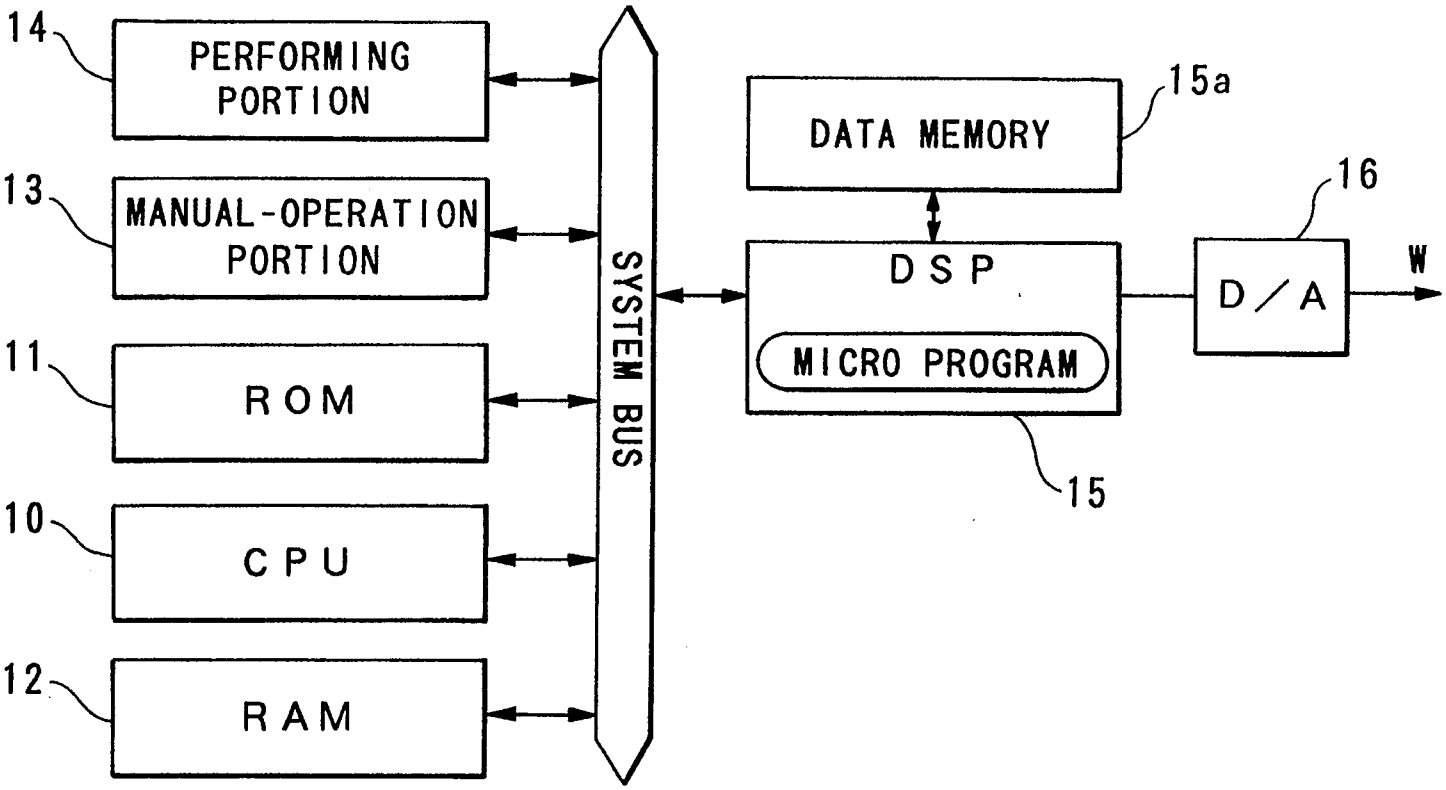
FIG. 1 is a block diagram showing a whole configuration of a musical tone synthesizing apparatus according to an embodiment of the present invention.

FIG. 1 is a block diagram showing an electronic configuration of the musical tone synthesizing apparatus according to an embodiment of the present invention as a whole. In FIG. 1, a numeral 10 designates a central processing unit (i.e., CPU) which controls several portions of the circuitry. Incidentally, the processing of the CPU 1 will be described later. A read-only memory (i.e., ROM) 11 stores several kinds of control programs which are read out from the CPU 10. A random-access memory (i.e., RAM) is provided as a work area for the CPU 10, wherein several kinds of values of registers will be temporarily stored.

A numeral 13 designates a manual-operation portion on which panel face several kinds of panel switches or auxiliary manual-operable members are arranged. More specifically, the manual-operation portion 13 provides so-called pitch benders as the auxiliary manual-operable members in addition to several kinds of switches such as filter-coefficient designating switches and tone-color designating switches. The pitch bender is used to continuously control the tone pitch of the musical tone to be produced, while the filter-coefficient designating switches designate an all-pass filter coefficient "c" and a low-pass filter coefficient respectively. In short, the manual-operation portion 13 produces manual-operation information in response to the manual operation applied to each of the switches and auxiliary manual-operable members. This manual-operation information is supplied to the CPU 10 by means of a system bus. A numeral 14 designates a performing portion which creates performance information, representing keycodes KC and the like, in response to a performing operation made by a performer.

A numeral 15 designates a digital signal processor (i.e., DSP). The DSP 15 carries out operational processes in accordance with micro programs which are read from a data memory 15*a*. The detailed operations of the DSP 15 will be described later. Further, a numeral 16 designates a digital-to-analog converter (i.e., D/A converter) which converts a digital output of the DSP 15 into an analog signal. This analog signal is outputted from the D/A converter 15 as a musical tone signal W.

Figure 2:
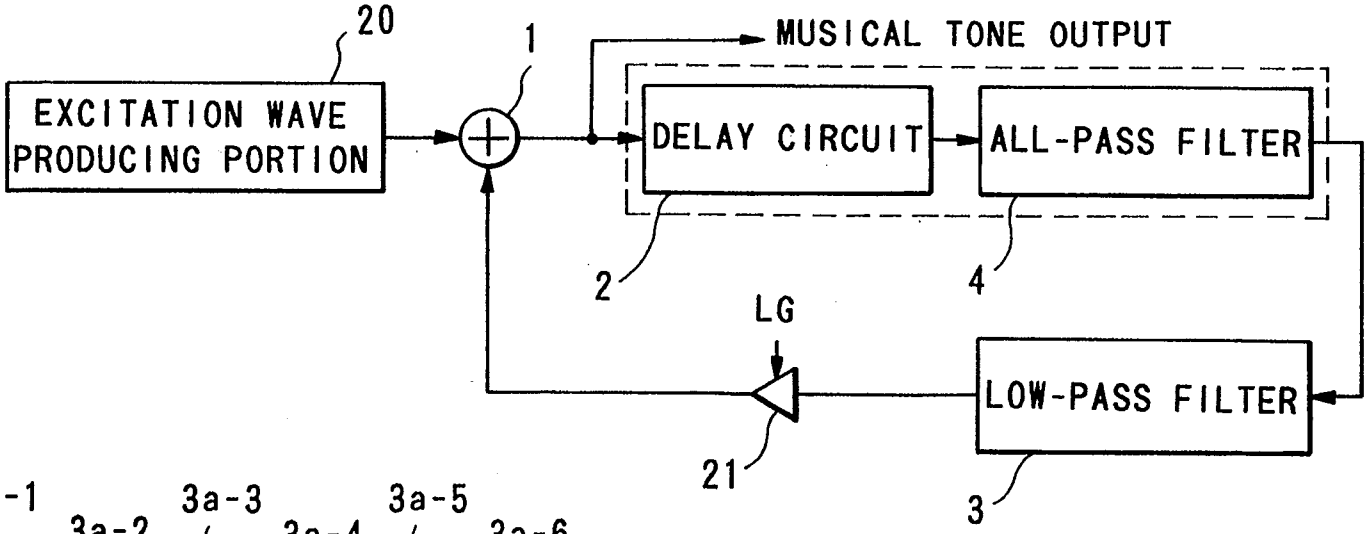
FIG. 2 is a block diagram showing a functional model of a digital signal processor (i.e., DSP) used in the embodiment.
Figure 3:
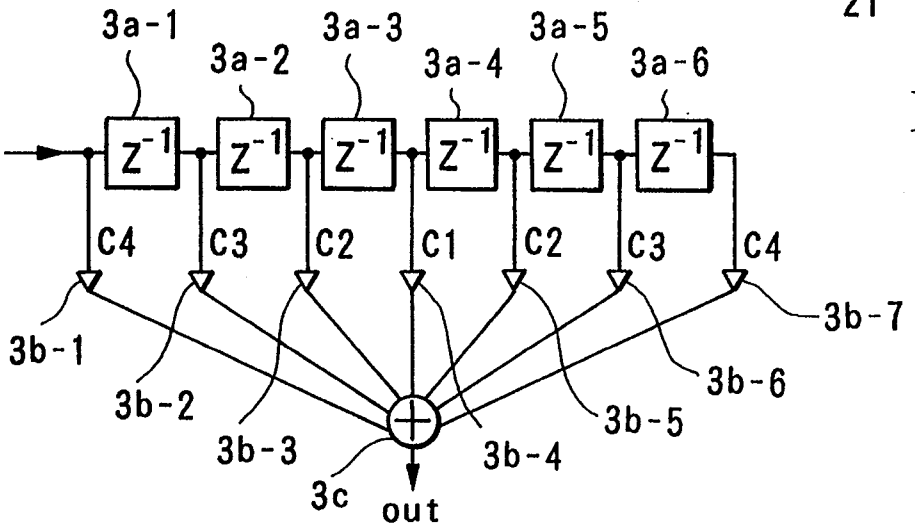
FIG. 3 is a block diagram showing a detailed configuration of a low-pass filter used in the DSP.
Figure 18:
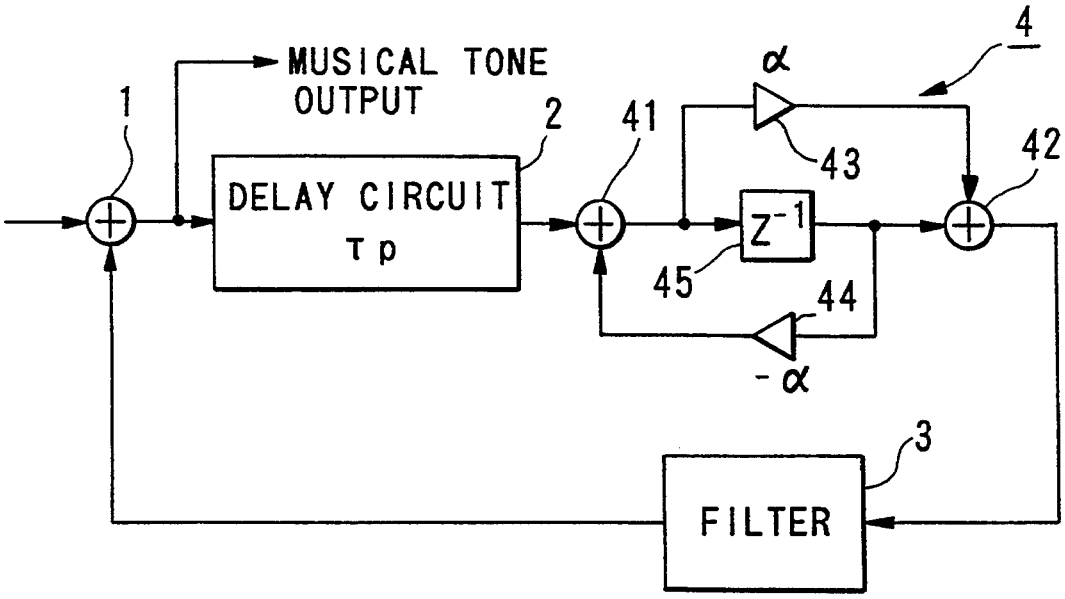
FIG.18 (PRIOR ART)
FIG. 18 is a block diagram showing another example of the conventional musical tone synthesizing apparatus.
Figure 19A:
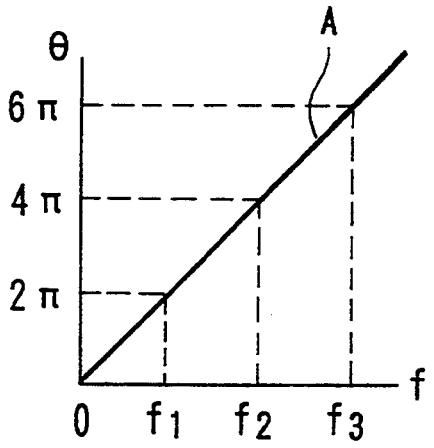
FIGS. 19(A), 19(B) and 19(C) are graphs which are used for explaining operations of the conventional musical tone synthesizing apparatus.
Figure 19B:
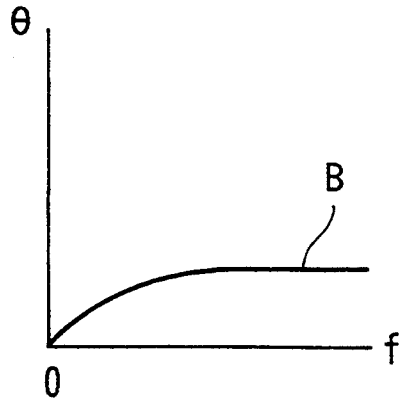
Figure 19C:
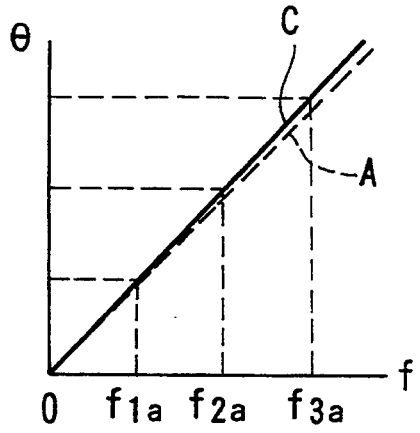

FIG. 2 is a block diagram showing a musical tone synthesizing model which is embodied by the operational processing performed by the DSP 15. In FIG. 2, parts identical to those shown in FIG. 18 will be designated by the same numerals, hence, description thereof will be omitted. Different from the circuitry shown in FIG. 18, a low-pass filter which is configured on the basis of the finite-impulse-response-type digital filter (i.e., FIR digital filter) as shown in FIG. 3 is employed as the filter 3, while a coefficient multiplier 21 is newly inserted between the adder 1 and the low-pass filter 3 so as to control the closed-loop gain. This circuitry shown in FIG. 3 is designed to control a filter coefficient and a gain coefficient on the basis of a result of the processing performed by the DSP 15 which will be described later. Thus, the present invention is characterized by that the whole delay amount of the closed loop can be smoothly changed without causing any change of the amplitude of the musical tone.

In FIG. 2, an excitation wave producing portion 20 produces a noise signal. The noise signal is subjected to an integral-stage delay by the delay circuit 2, and then, it is subjected to a decimal-stage delay by the all-pass filter 4. Herein, the integral-stage delay corresponds to the sampling period $\tau_s$, in other words, the integral-stage delay corresponds to the number of delay stages provided in the shift register. On the other hand, the delay time corresponding to the decimal-stage delay is smaller than the sampling period $\tau_s$, in other words, the decimal-stage delay represents the delay time which is smaller than the delay time corresponding to one delay stage of the shift register. In the description given below, the delay amount of the delay circuit 2 will be sometimes referred to as "an integral part of delay", while the delay amount of the all-pass filter 4 will be sometimes referred to as "a decimal part of delay".

In short, an allowable range of the delay time "t" of the all-pass filter 4 is limited between "0" and "1". Thus, a relationship between the delay time t and the filter coefficient c can be approximately expressed by the following equation: $c=\beta(1-t)$. More precisely, this equation can be rewritten as follows: $c=\beta(1-t/1+t)$. When the delay amount of the all-pass filter 4 becomes equal to "0", the corresponding filter coefficient c becomes equal to "−1". This relationship coincides with the pole arrangement of the filter 4. In this case, however, the operation of the filter 4 becomes unstable. In order to avoid the unstable operation of the filter 4 and the increase of the error of the delay amount, a value $\beta$ used in the aforementioned approximate expression is set as $\beta \approx -1$, whereas its absolute value is smaller than "1" (i.e., $|\beta|<1$).

As described above, the signal is subjected to the integral-stage delay and the decimal-stage delay by the delay circuit 2 and the all-pass filter 4 respectively. The delayed signal is supplied to the low-pass filter 3 wherein the tone color thereof is adjusted. Then, its loop gain is adjusted by the coefficient multiplier 21. Thereafter, the output signal of the coefficient multiplier 21 is supplied to the adder 1. As the signal circulating through the closed loop shown in FIG. 2, it is possible to synthesize the attenuating signal having a tone pitch which corresponds to the whole delay amount of the closed loop. The fundamental operation of this circuitry shown in FIG. 2 is similar to that of the conventional circuitry shown in FIG. 18. However, the feature of the present invention lies in that the whole delay amount of the closed loop can be changed without causing the discontinuity in the amplitude of the signal circulating through the closed loop, which will be described later.

FIG. 3 is a block diagram showing an example of an electronic configuration of the low-pass filter 3. This low-pass filter 3 is configured as the FIR digital filter which consists of delay circuits **3*a*-1 to 3*a*-6, coefficient multipliers 3*b*-1 to 3*b*-7 and an adder 3*c*. Each of the delay circuits 3*a*-1 to 3*a*-6 delays the input signal thereof by one sampling period $\tau$. Respective multiplication coefficients are applied to the coefficient multipliers 3*b*-1 to 3*b*-7 in a symmetrical manner with respect to the coefficient multiplier 3*b*-4 which is positioned at the center point among them. Such symmetrical application of the multiplication coefficients c1 through c4** makes it possible to change the cut-off frequency while maintaining the delay time at a constant value "D".

[B] Fundamental Operation

Next, the fundamental operation of the present embodiment will be described in detail by referring to FIGS. 4 to 8. At first, when the power is applied to the musical tone synthesizing apparatus, the CPU 10 reads out the control programs from the ROM 11 so as to start a processing of a main routine shown in FIG. 4. When the main routine is started, the processing of the CPU 10 proceeds to step Sa1. In step Sa1, predetermined initial values are respectively set to several kinds of registers, while the CPU 10 instructs the DSP 15 to input the predetermined micro programs which are stored in the data memory **15*a*. In addition, tone color data which is read from the ROM 11 is set to a predetermined area of the RAM 12**.

After completing the initialization process of step Sa1, the processing of the CPU 10 proceeds to step Sa2. Herein, in order to detect the manual operations applied to the manual-operation portion 13 and the performing portion 14, the CPU 10 scans each of the keys and switches. Then, flags are produces in response to setting states of the keys and switches, and these flags are set to registers. In next step Sa3, a voice process is carried out. In the voice process, the tone color data corresponding to the setting states of the tone color switches which are detected by a scanning process of step Sa2 are read from the ROM 11 so as to set them to a predetermined area of the RAM 12. Thus, a preparation for the musical tone synthesis is completed.

In step Sa4, when a key-on event is occurred, the CPU 10 creates an instruction by which the musical tone is produced in response to a key code KC to be produced responsive to the performing operation. The details of a key-on process will be described later. In next step Sa5, when a key-off event is occurred, a key-off parameter is produced in accordance with a key-off routine which will be described later. Based on the key-off parameter, the musical tone which is produced responsive to the key-on event is attenuated and muted in tone volume by a predetermined rate. In step Sa6, the CPU 10 carries out the other processes, by which a sound effect is imparted to the musical tone by performing a reverberation operation or a delay operation, for example. Thereafter, the processing of the CPU 10 returns back to the foregoing step Sa1, so that the processes of steps Sa2 to Sa6 described above are repeatedly carried out.

[C] Processing of Routine

Next, each of the processings of the routines which are called by the main routine will be described in detail, and then, the operation of the DSP 15 will be described. Herein, the DSP 15 functions to synthesize the attenuating sound on the basis of the instructions and commands given from the CPU 10.

(1) Key-On Routine

Figure 6:
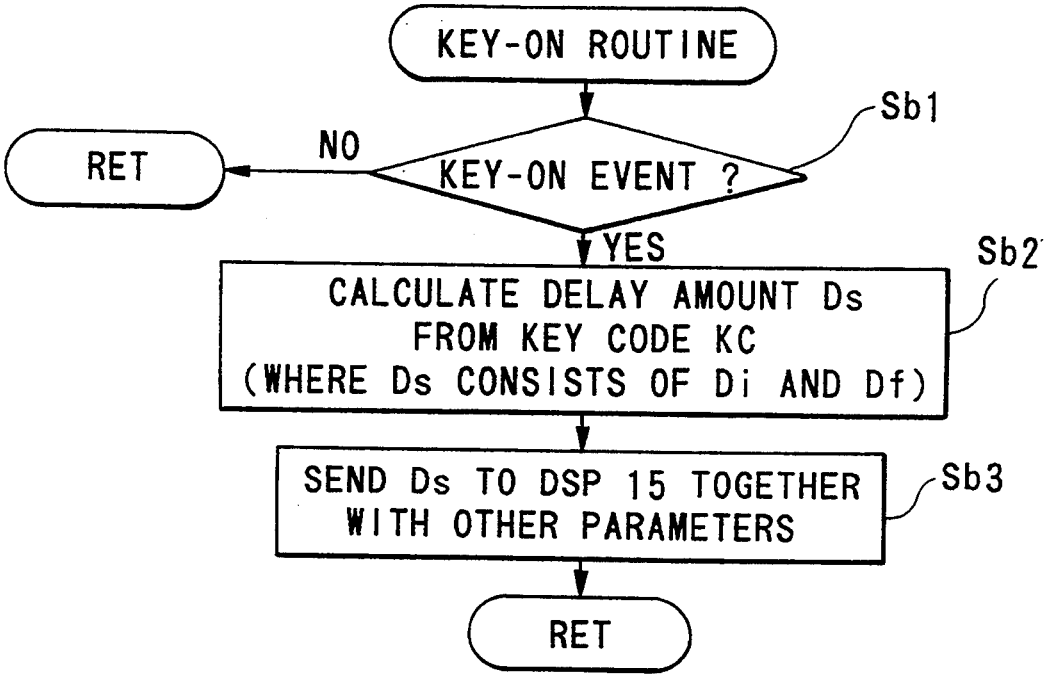
FIG. 6 is a flowchart showing a key-on routine.

When the processing of the CPU 10 proceeds to the step Sa4, a key-on routine as shown in FIG. 6 is started. In first step Sb1, it is judged whether or not the key-on event is occurred. If the key-on event is not occurred, the result of the judgement turns to "NO", so that the processing returns back to the main routine. On the other hand, when the performer operates the key so that the key-on event is occurred, the judgement result turns to "YES" so that the processing proceeds to step Sb2.

In step Sb2, in order to produce the musical tone having a tone pitch corresponding to the key code KC which is produced responsive to the performing operation applied to the key, a whole delay amount "Ds" of the closed loop is calculated. Herein, a note frequency F corresponding to the key code KC is calculated, and then, the whole delay amount Ds is calculated by use of a relational expression "Ds=fs/F" (where "fs" denotes the sampling frequency). This delay amount Ds consists of an integral part Di and a decimal part Dr. Next, the all-pass filter coefficient c corresponding to the decimal part Df is calculated by use of the foregoing equation "$c=\beta(1-t)$". In next step Sb3, the all-pass filter coefficient c and the decimal part Df are sent to the DSP 15, while a reset signal which resets an envelope generator (not shown) is also sent to the DSP 15. Thus, the DSP 15 receives some parameters which are required for producing the musical tone. Therefore, the DSP 15 functions to produce the musical tone in accordance with the musical tone synthesizing algorithm, which will be described later.

(2) Routine of Manual-Operable Member

Figure 5:
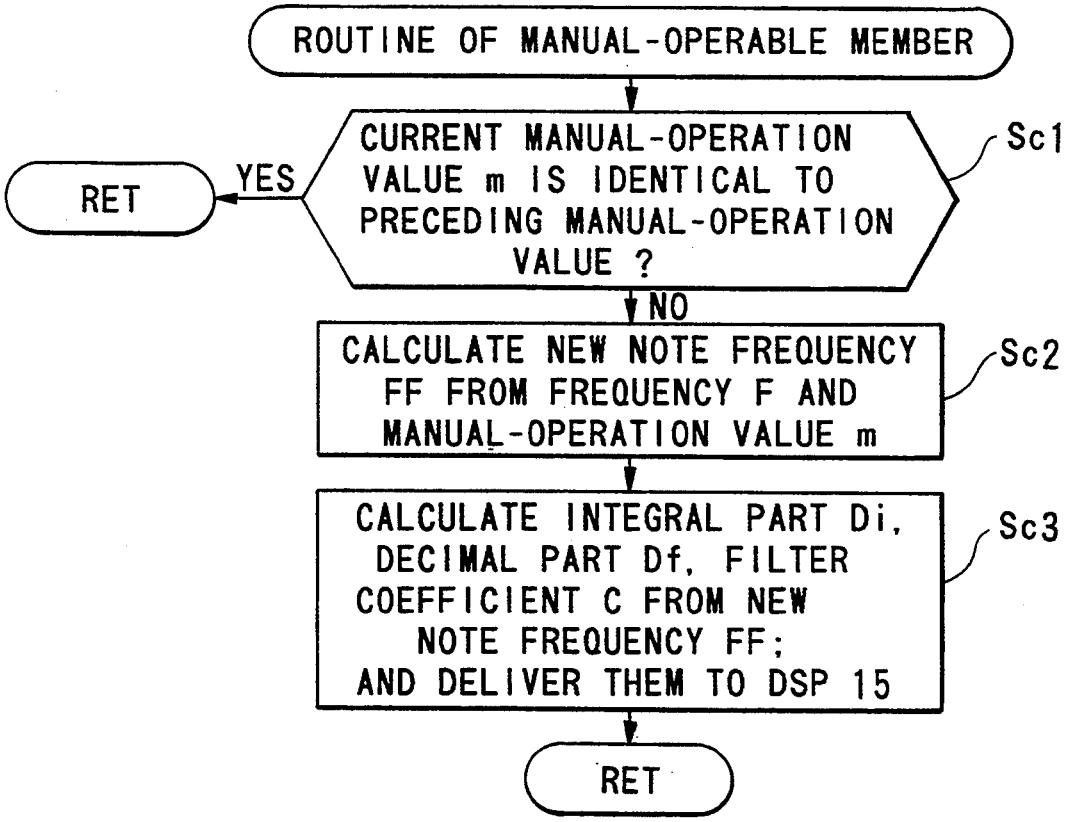
FIG. 5 is a flowchart showing a routine of manual-operable member.

For example, when the aforementioned pitch bender is operated while a certain musical tone is produced by the key-on routine, a routine of manual-operable member as shown in FIG. 5 is started, so that the processing of the CPU 10 firstly proceeds to step Sc1. Herein, the pitch bender is one of the auxiliary manual-operable members, and this pitch bender is used to smoothly alter the tone pitch of the musical tone to be produced. In step Sc1, it is judged whether or not a current manual-operation amount "m" applied to the pitch bender is identical to the preceding manual-operation amount. In other words, it is judged whether or not the pith bender is operated. When no change is detected in the manual-operation amount m, it is judged that the pitch bender is not operated. In this case, the judgement result of step Sc1 turns to "YES", so that the processing directly returns back to the main routine.

In contrast, when a change is detected in the manual-operation amount m, the judgement result turns to "NO" so that the processing proceeds to step Sc2. In step Sc2, a new note frequency FF is computed on the basis of the detected manual-operation amount m (belonging to a range between "−1" and "1") and the aforementioned note frequency F by use of a relational expression "FF=F*exp(s*m)". Incidentally, "s" represents a parameter of sensitivity of the pitch bender.

In next step Sc3, the whole delay amount Ds of the closed loop is calculated in response to the new note frequency FF which is computed in step Sc2. Further, the integral part Di and the decimal part Df are newly separated from the delay amount Ds corresponding to the new note frequency FF, and then, a new all-pass filter coefficient c is calculated in response to the new decimal part Dr. Thereafter, the integral part Di, the decimal part Df and the all-pass filter coefficient c which are newly calculated with respect to the new note frequency FF are sent to the DSP 15. Thus, under the operation of the DSP 15, the tone pitch of the musical tone can be altered in response to the manual-operation amount m applied to the pitch bender.

(3) Key-Off Routine

Figure 4:
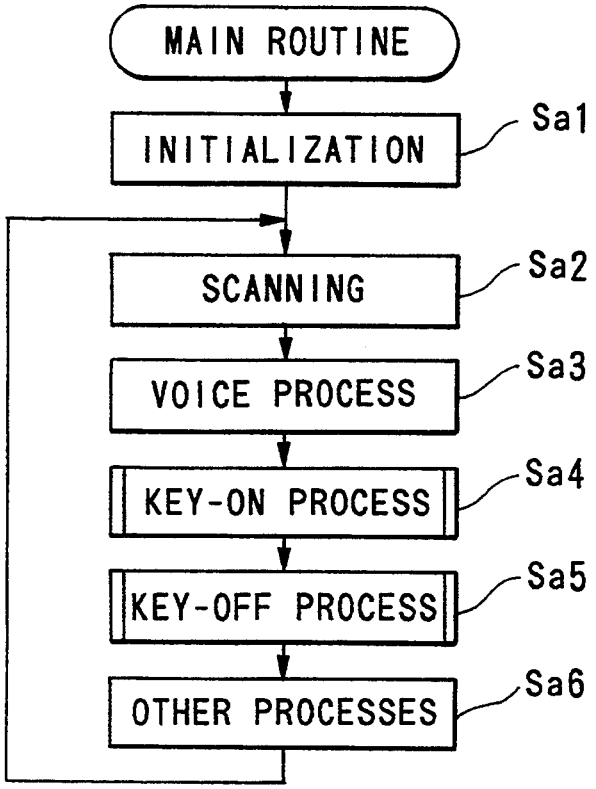
FIG. 4 is a flowchart showing a main routine.
Figure 7:
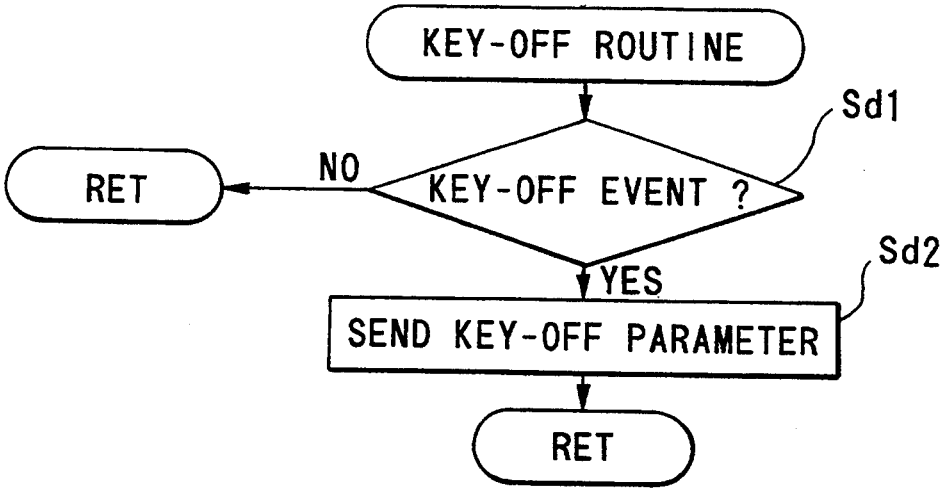
FIG. 7 is a flowchart showing a key-off routine.

When the processing of the CPU 10 proceeds to step Sa5 shown in FIG. 4, a key-off routine as shown in FIG. 7 is started. In first step Sd1, it is judged whether or not a key-off event is occurred. If the current key event is not the key-off event, the judgement result turns to "NO" so that the processing returns back to the main routine. On the other hand, when the key-off event is occurred, the judgement result turns to "YES" so that the processing proceeds to step Sd2. In step Sd2, in order to damp the output of the envelope generator by the predetermined rate, several kinds of key-off parameters are produced and supplied to the DSP 15. As a result, the musical tone which is now generated by the DSP 15 (functioning as the sound source) is damped down (or attenuated) and then muted.

(4) Operation of DSP 15

Figure 8:
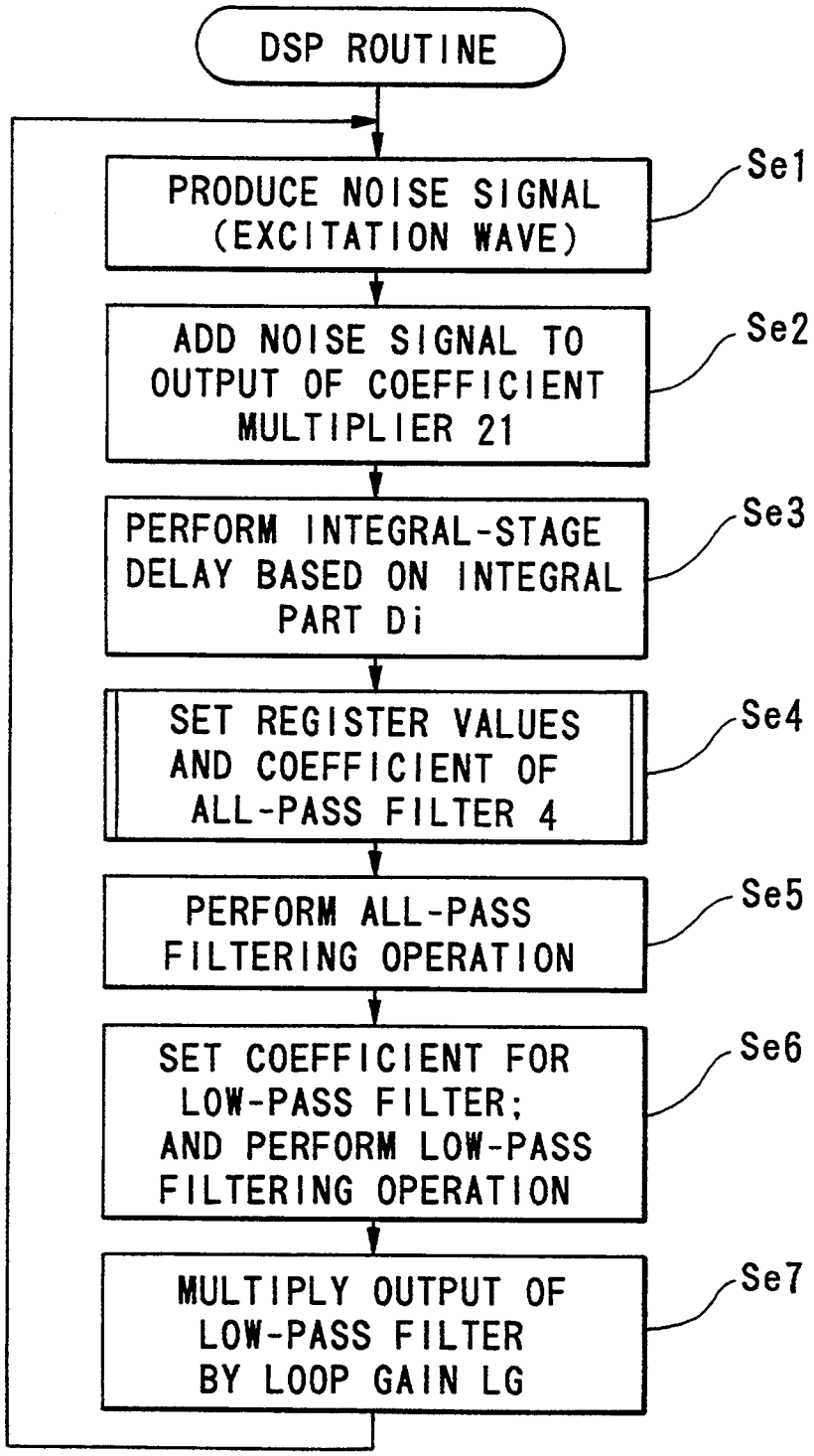
FIG. 8 is a flowchart showing a DSP routine.

Next, the operation of the DSP 15 will be described by referring to FIG. 8. The DSP 15 is designed to synthesize the musical tone signal in accordance with the micro programs. As described before, when the CPU 10 instructs the DSP 15 to read the micro programs in the initializing operation, the DSP 15 loads the micro programs so as to start a DSP routine as shown in FIG. 8. Thus, the processing of the DSP 15 proceeds to step Se1 at first. In step Se1, the DSP 15 creates an initial excitation wave which is applied to the closed loop. As the initial excitation wave, it is possible to employ a white-noise signal in which a density of a power spectrum is constant.

In next step Se2, the result of the multiplication performed by the coefficient multiplier 21 (which is provided in the closed loop as shown in FIG. 2) is calculated. Then, the output of the coefficient multiplier 21 is added with the above-mentioned white-noise signal (hereinafter, simply referred to as a noise signal). In step Se3, the number of the delay stages to be provided in the delay circuit 2 is determined on the basis of the integral part Di of the delay amount Ds which is supplied to the DSP 15 from the CPU 10, so that the noise signal is delayed by a delay time corresponding to the determined number of the delay stages (herein, a certain integral number is determined as the number of the delay stages). In step Se4, in order to delay the output of the delay circuit 2 by a certain delay time which corresponds to the decimal part Df of the delay amount Ds, the all-pass filter coefficient c given from the CPU 10 is set, while a predetermined value is set to a register (i.e., delay circuit 45 shown in FIG. 18) which is a circuit element of the all-pass filter 4. The details of the process of step Se4 will be described later.

In step Se5, a filtering operation which functions to perform the foregoing decimal-stage delay is carried out on the basis of the all-pass filter coefficient c which is set in step Se4. In next step Se6, each of the coefficients used in the low-pass filter 3 (see FIG. 3) is set, and then, a low-pass filtering operation is carried out. In next step Se7, the output of the low-pass filter 3 is multiplied by a loop gain LG. Thereafter, the processing of the DSP 15 returns to the foregoing step Se1, and consequently, the above-mentioned processes of steps Se1 through Se7 are repeatedly carried out.

[D] Delay Control of DSP 15

Next, the description will be given with respect to the delay control operation performed by the DSP 15 by referring to FIGS. 9 to 14. As described before, in order to continuously alter the tone pitch of the musical tone to be produced by controlling the integral part Di and the decimal part Df of the delay amount Ds respectively, it is necessary to discontinuously control the all-pass filter coefficient c. However, if the coefficient c is controlled discontinuously, the noises are caused. In order to avoid such drawback, the following control methods are provided.

(1) First Control Method

This first control method is employed when the whole delay amount (Ds) of the closed loop is changed from "9.999" to "10.000", for example. In this case, the coefficient c of the all-pass filter 4 is controlled such that the delay amount in the transfer function of the closed loop (which is determined by the integral part Di and the decimal part Df) can be approximately maintained as it is. In order to satisfy a so-called "boundary condition" which is required when the delay amount is changed from "9.999" to "10.000", a delay value of the all-pass filter 4 should be approximately equal to "1" just before the delay amount turns to "10.000".

More specifically, if the filter coefficient c is set at "0" when computing a result of the transfer function H(z) of the all-pass filter 4, where $H(z)=z^{-1}-c/1-cz^{-1}$, the transfer function H(z) is rewritten as follows: $H(z)=z^{-1}$. This expression satisfies the aforementioned boundary condition. At a moment when the delay amount turns to "10.000", the decimal part Df which is embodied by the all-pass filter 4 should be equal to "0", while the current amplitude should be identical to the preceding amplitude in the output waveform of the DSP 15. In order to do so, the filter coefficient c should be set at "−1" in the transfer function $H(z)=z^{-1}-c/1-cz^{-1}$. When the filter coefficient c is set equal to "−1", the transfer function H(z) is rewritten as follows: $H(z)=1$. This indicates that the decimal part Df becomes equal to "0". Further, in order to maintain the same amplitude before and after the boundary condition, a value of "$z^{-1}$" is initialized to zero (i.e., $z^{-1}=0$).

Actually, however, when the filter coefficient c is set at "−1", the operation of the all-pass filter 4 goes unstable. So, an allowable range of the filter coefficient c is limited such that a difference between a first delay amount (which is emerged before the boundary condition) and a second delay amount (which is emerged after the boundary condition) can be negligible, whereas the filter coefficient c is set close to "−1" and the absolute value thereof is smaller than "1" (i.e., $|c|<1$). Thus, in the case where the sampling frequency fs is set at 50 kHz and twelve delay stages are set for the delay circuit 2, the musical tone signal picked up from the closed loop provides a tone pitch having a frequency 4 kHz under the above-mentioned delay control operation. As the number of the delay stages is decreased by one, the tone pitch is altered by "+150" cents. Therefore, if the delay amount is changed from "12.0" (i.e., 150.64 cents) to "12.01" (i.e., 149.06 cents), a pitch error is smaller than 1 cent, for example. This do not cause any practical problems.

Next, the description will be given with respect to another boundary condition where the delay amount is decreased from "10.000" to "9.999". Even in this case, when the filter coefficient c is approximately set equal to "−1" (i.e., $c \approx -1$), this boundary condition can be set equivalent to the foregoing boundary condition. Further, in order to maintain the same amplitude before and after the boundary condition, a previous value used at a previous moment which is one sampling period prior to the current moment should be set to "$z^{-1}$" as its initial value.

Figure 9:
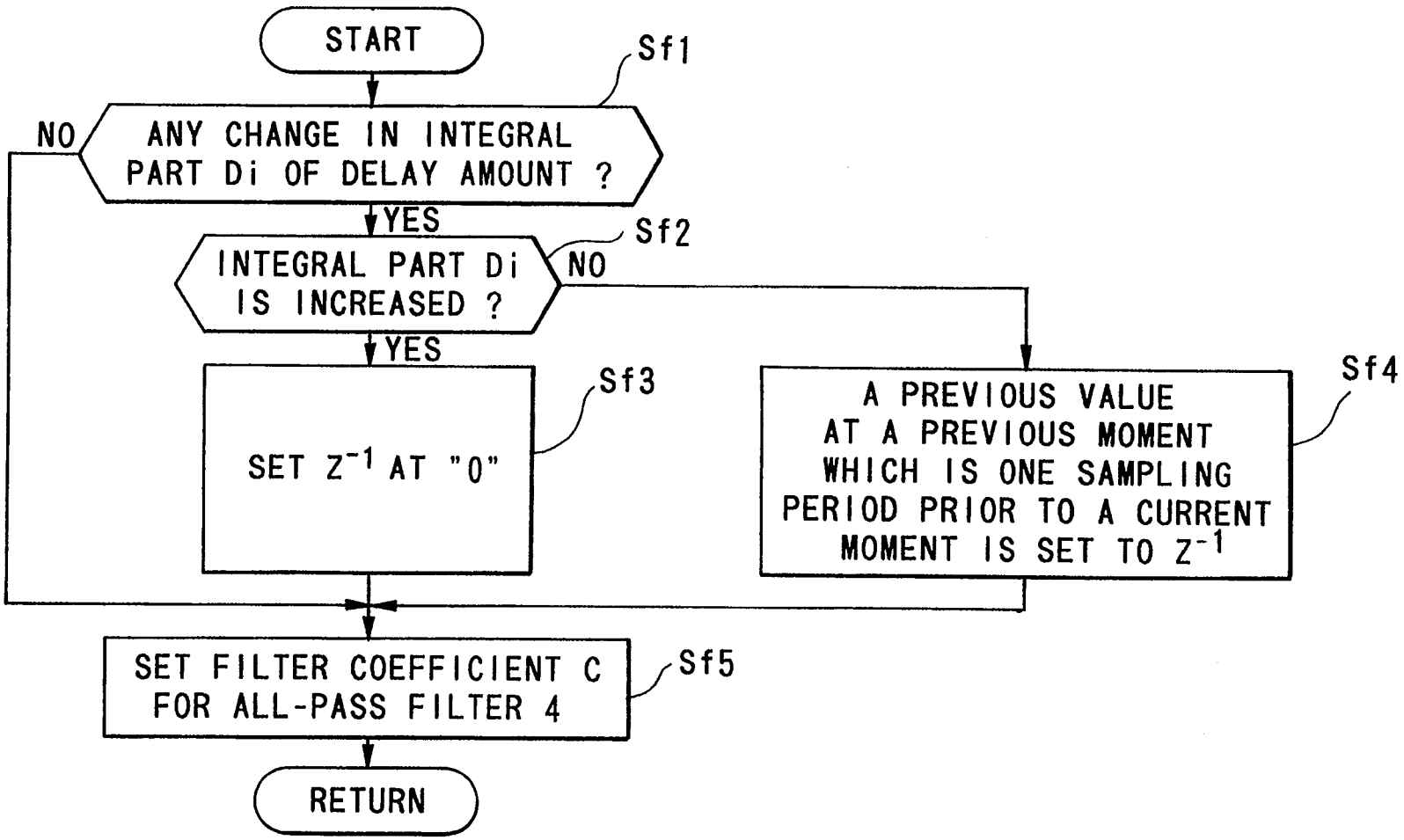
FIG. 9 is a flowchart which is used for explaining a first control method employed by the embodiment.

Next, the processing of the DSP 15 which embodies the first control method described above will be described by referring to FIG. 9. As described before, when the processing of the DSP 15 proceeds to step Se4, a routine as shown in FIG. 9 is started. In first step Sf1, it is judged whether or not the integral part Di of the delay amount is changed. If the integral part Di is not change in the delay amount, the judgement result turns to "NO" so that the processing jumps to step Sf5. In step Sf5, the filter coefficient c which is given from the CPU 10 and which corresponds to the decimal part Df is set to the all-pass filter 4.

On the other hand, when the integral part Di is changed, the judgement result of step Sf1 turns to "YES", so that the aforementioned first control method is carried out. In step Sf2, it is judged whether or not the integral part Di is increased. When the integral part Di is increased, the processing proceeds to step Sf3 wherein a value "0" is set to the register 45 (see FIG. 18) so as to initialize the register 45. On the other hand, when the integral part Di is decreased, a value used at a previous moment which is one sampling period prior to the current moment is set to the register 45. Then, the processing proceeds to step Sf5 wherein the filter coefficient c is determined such that the filter coefficient c is close to "−1" and the absolute value thereof is smaller than "1". Due to the above-mentioned delay control operation, it is possible to continuously control the tone pitch of the musical tone without causing the noises. In other words, it is possible to alter the tone pitch in response to the manual operation applied to the pitch bender.

(2) Second Control Method

The above-mentioned first control method performs a continuous control on the tone pitch by matching the boundary conditions before and after the integral part Di of the delay amount is changed. However, when the variation of the delay amount becomes large in the actual system, it is predicted that the tone pitch cannot be controlled continuously by use of the first control method only. For example, when the integral part Di of the delay amount is largely changed and exceeds over the value "1", the matching operation for the boundary condition may be meaningless. In this case, the coefficient c of the all-pass filter 4 is largely changed by each sampling period $\tau_s$, which causes a discontinuity in the waveform to be produced.

For the above reason, when the integral part Di of the delay amount is changed largely, the filter coefficient c is set as if the all-pass filter 4 is not existed apparently. In short, the coefficient c is determined such that the decimal part Df of the delay amount becomes equal to "0". On the other hand, when the variation of the integral part Di is relatively small, the operation of the DSP 15 is controlled in accordance with the foregoing first control method.

Figure 10:
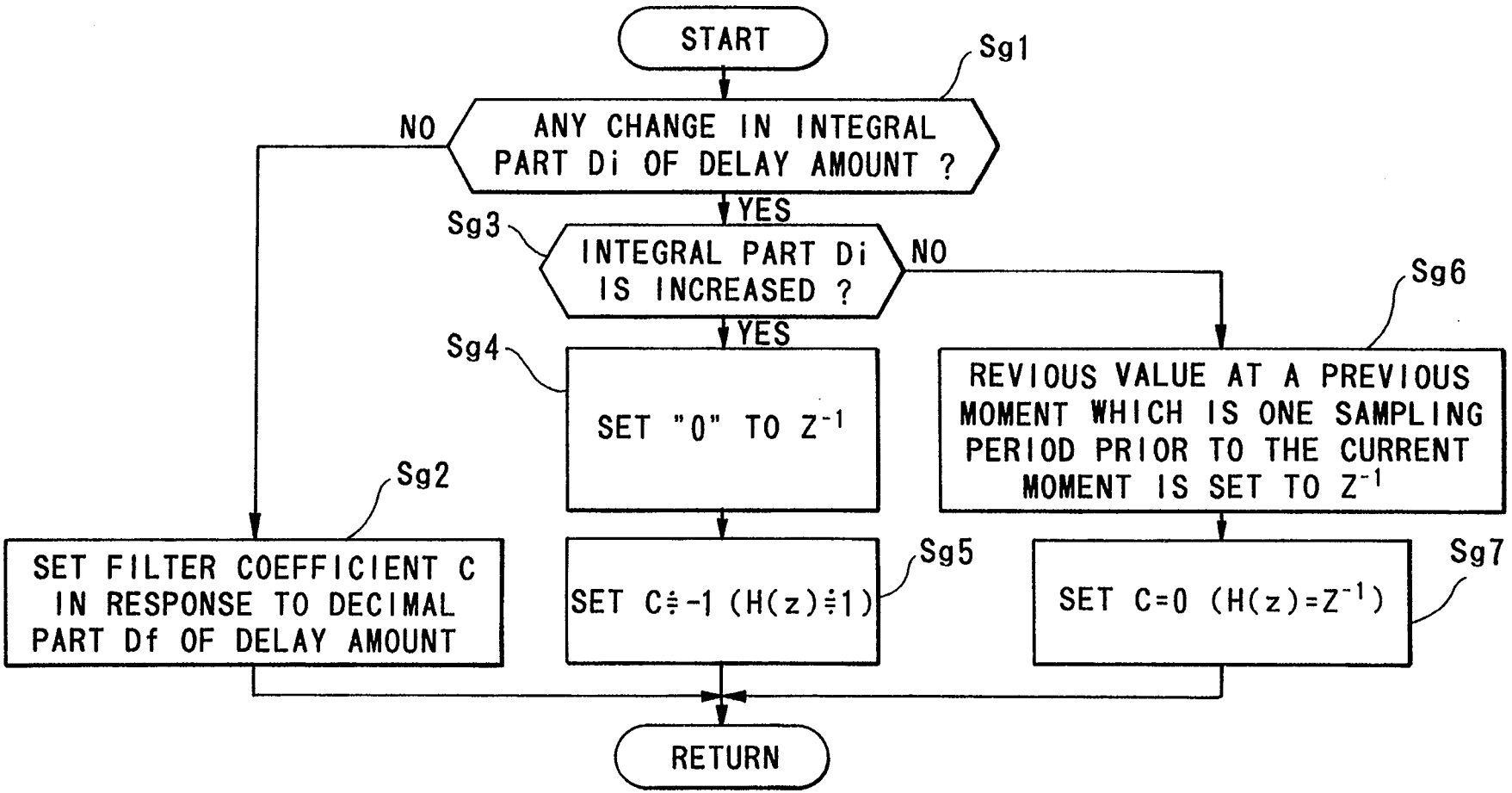
FIG. 10 is a flowchart which is used for explaining a second control method.

Next, the operation of the DSP 15 which embodies the second control method will be described in detail by referring to FIG. 10. As described before, when the processing of the DSP 15 proceeds to step Se4 shown in FIG. 8, the processing proceeds to step Sg1 shown in FIG. 10. In step Sg1, it is judged whether or not the integral part Di of the delay amount is changed. If the integral part Di is not changed, the judgement result turns to "NO" so that the processing jumps to step Sg2. In step Sg2, the filter coefficient c which is sent from the CPU 10 and which corresponds to the decimal part Df is set to the all-pass filter 4. .

On the other hand, when the integral part Di is changed, the judgement result turns to "YES", so that the processing proceeds to step Sg3. In step Sg3, it is judged whether or not the integral part Di is increased. When the integral part Di is increased, the processing proceeds to step Sg4. In step Sg4, a value "0" is set to the register 45 (see FIG. 18) so as to initialize the register 45. In next step Sg5, the filter coefficient c is approximately set equal to "−1" (i.e., $c \approx -1$), by which the transfer function H(z) of the all-pass filter 4 is rewritten as follows: $H(z) \approx 1$.

In contrast, when the integral part Di is decreased, the judgement result of step Sg3 turns to "NO", so that the processing branches to step Sg6. In step Sg6, a previous value used at a previous moment which is one sampling period prior to the current moment is set to the register 45. Then, the processing proceeds to step Sg7. In step Sg7, the filter coefficient c is set at "0", by which the transfer function H(z) of the all-pass filter 4 is rewritten as follows: $H(z)=z^{-1}$. Thus, the flowchart shown in FIG. 10 embodies the second control method.

(3) Third Control Method

Figure 11:
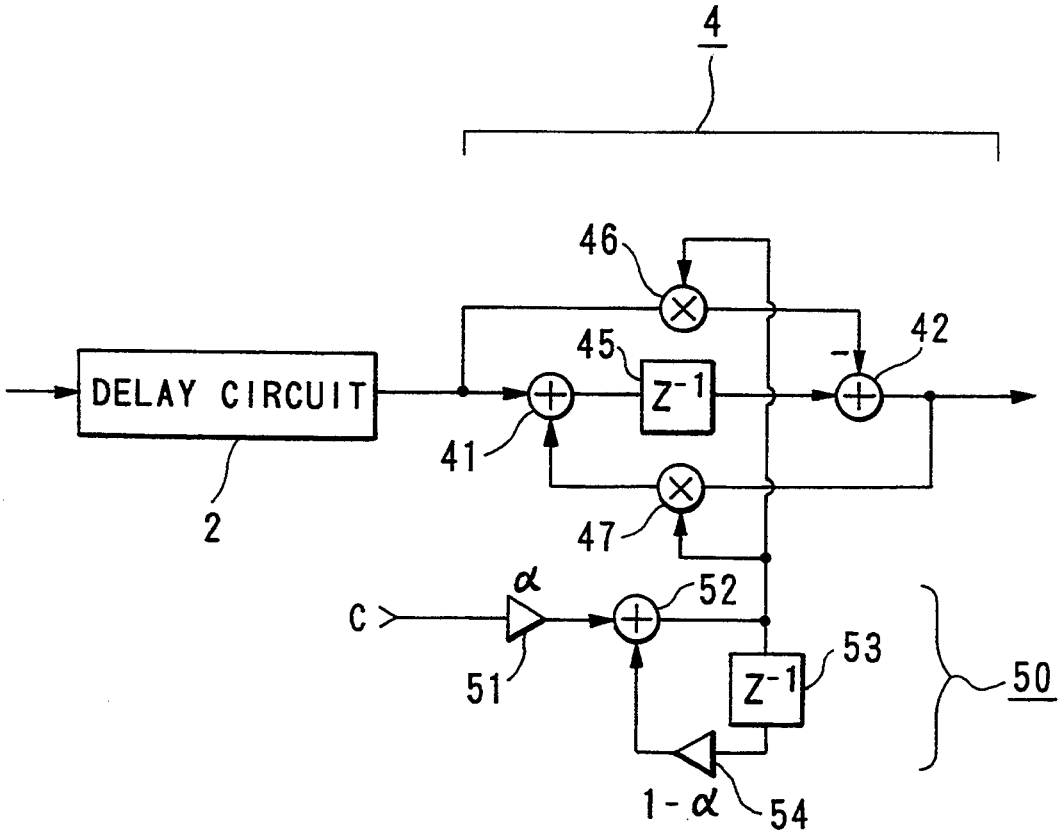
FIG. 11 is a block diagram showing an essential part of a modified example of the DSP.

Meanwhile, the discontinuity of the waveform is caused by a rapid change of the filter coefficient c of the all-pass filter 4. Even in the second control method, there is a possibility in that the filter coefficient c, which is set under the condition where the integral part Di of the delay amount is not changed, may cause the discontinuity of the waveform. Thus, in order to avoid the rapid change of the filter coefficient c, it is possible to newly employ an interpolation device. FIG. 11 shows a functional model of a main part of the DSP 15 which provide an interpolation device 50.

In the all-pass filter 4 shown in FIG. 11, the aforementioned coefficient multipliers 43, 44 (see FIG. 18) are replaced by multipliers 46, 47. The interpolation device 50 which is designed to supply respective coefficients to the multipliers 46, 47 is configured by a coefficient multiplier 51, an adder 52, a register 53 and a coefficient multiplier 54. This interpolation device 50 is not designed to function all the time. The interpolation device 50 is only operated when the integral part Di of the delay amount is changed. When the integral part Di is changed, the interpolation device 50 directly passes the filter coefficient c toward the all-pass filter 4 in order to perform the foregoing second control method. Incidentally, the circuit configuration of the interpolation device 50 in which the filter coefficient c is supplied to the all-pass filter 4 by means of the register 53 performing a delay operation is effective to avoid the discontinuous response of the all-pass filter 4.

Figure 12:
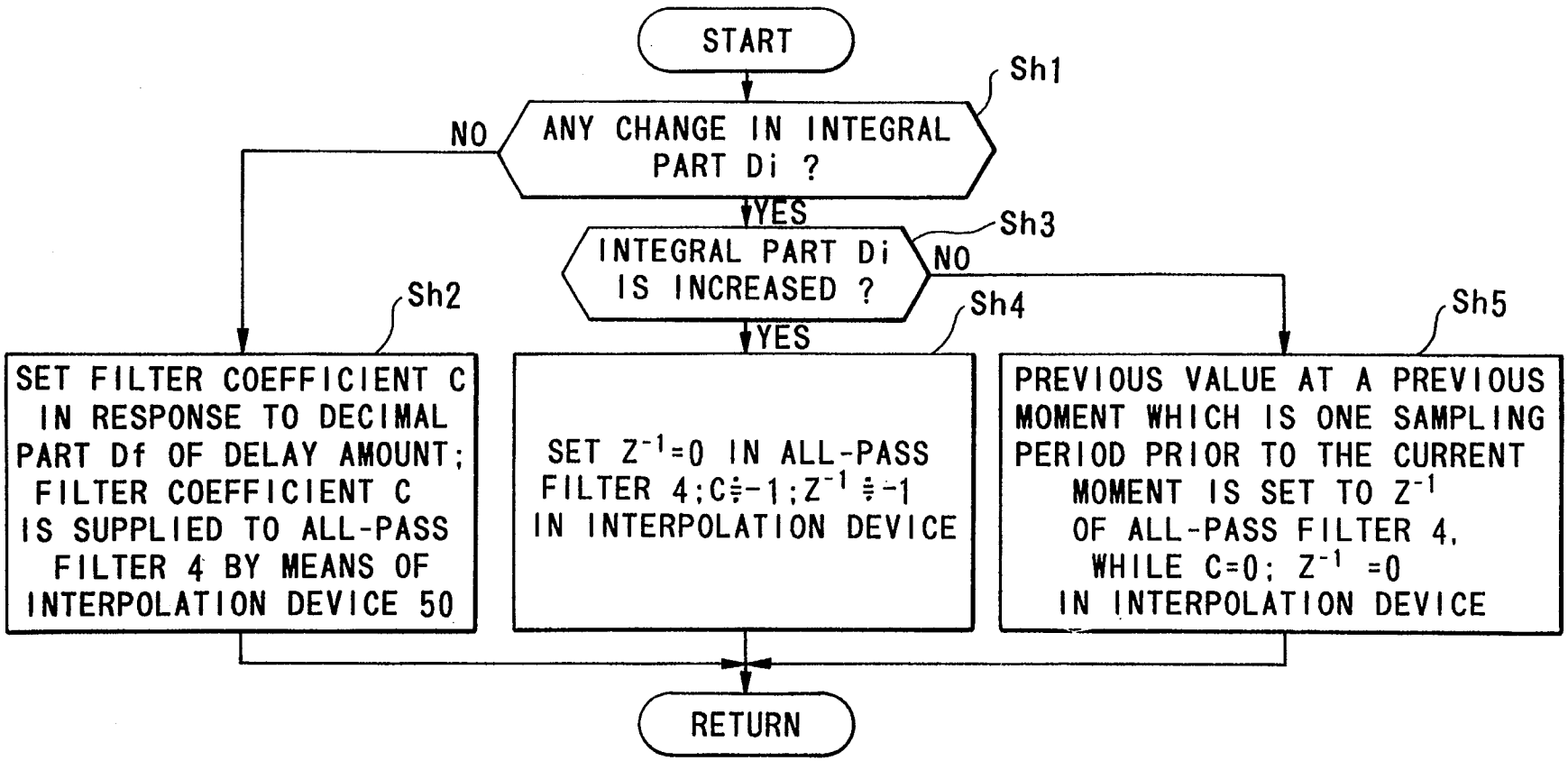
FIG. 12 is a flowchart which is used for explaining a third control method.

Next, the operation of the DSP 15 providing the interpolation device 50 will be described in detail by referring to FIG. 12. As described before, when the processing of the DSP 15 proceeds to step Se4 (see FIG. 8), a routine as shown in FIG. 12 is started. In first step Sh1, it is judged whether or not the integral part Di of the delay amount is changed. If the integral part Di is not changed, the judgement result turns to "NO" so that the processing branches to step Sh2. In step Sh2, the filter coefficient c which is sent from the interpolation device 50 and which corresponds to the decimal part Df of the delay amount is set to the all-pass filter 4.

On the other hand, when the integral part Di is changed, the judgement result of step Sh1 turns to "YES" so that the processing proceeds to step Sh3. In step Sh3, it is judged whether or not the integral part Di is increased. When the integral part Di is increased, the processing proceeds to step Sh4. In step Sh4, a value "0" is set to the register 45 so as to initialize the register 45. In addition, a value x which is approximately equal to "−1" (i.e., $x \approx -1$) is set as the filter coefficient c and is also set to the register 53. Thus, the transfer function H(z) of the all-pass filter 4 is rewritten as follows: $H(z) \approx -1$. In this case, the filter coefficient c (where $c \approx = 1$) is supplied to the interpolation device 50.

Figures 13A, 13B:
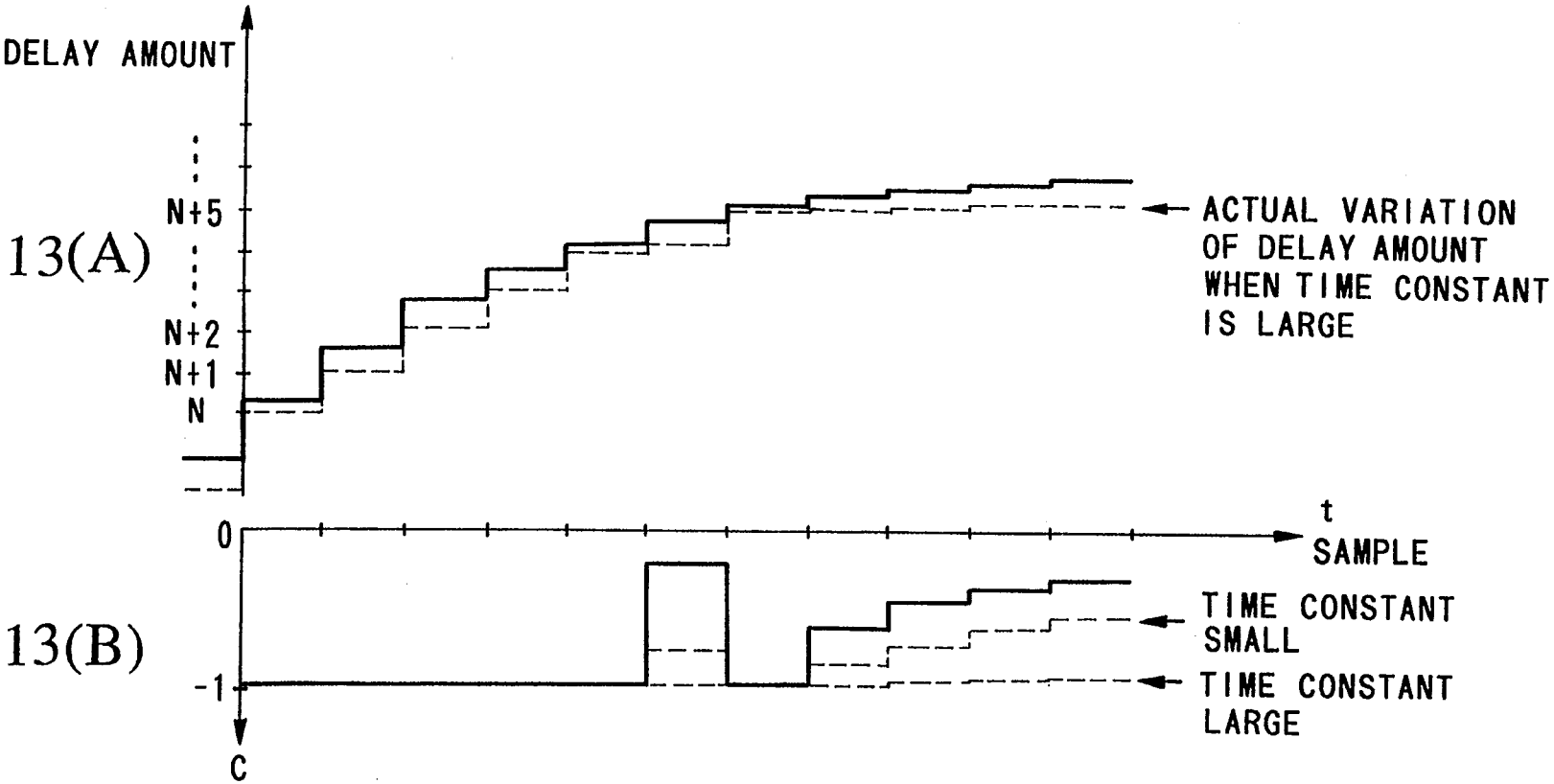
FIGS. 13(A), 13(B), 14(A), 14(B) are graphs which are used for explaining follow-up characteristics of an interpolation device shown in FIG. 11.
Figures 14A, 14B:
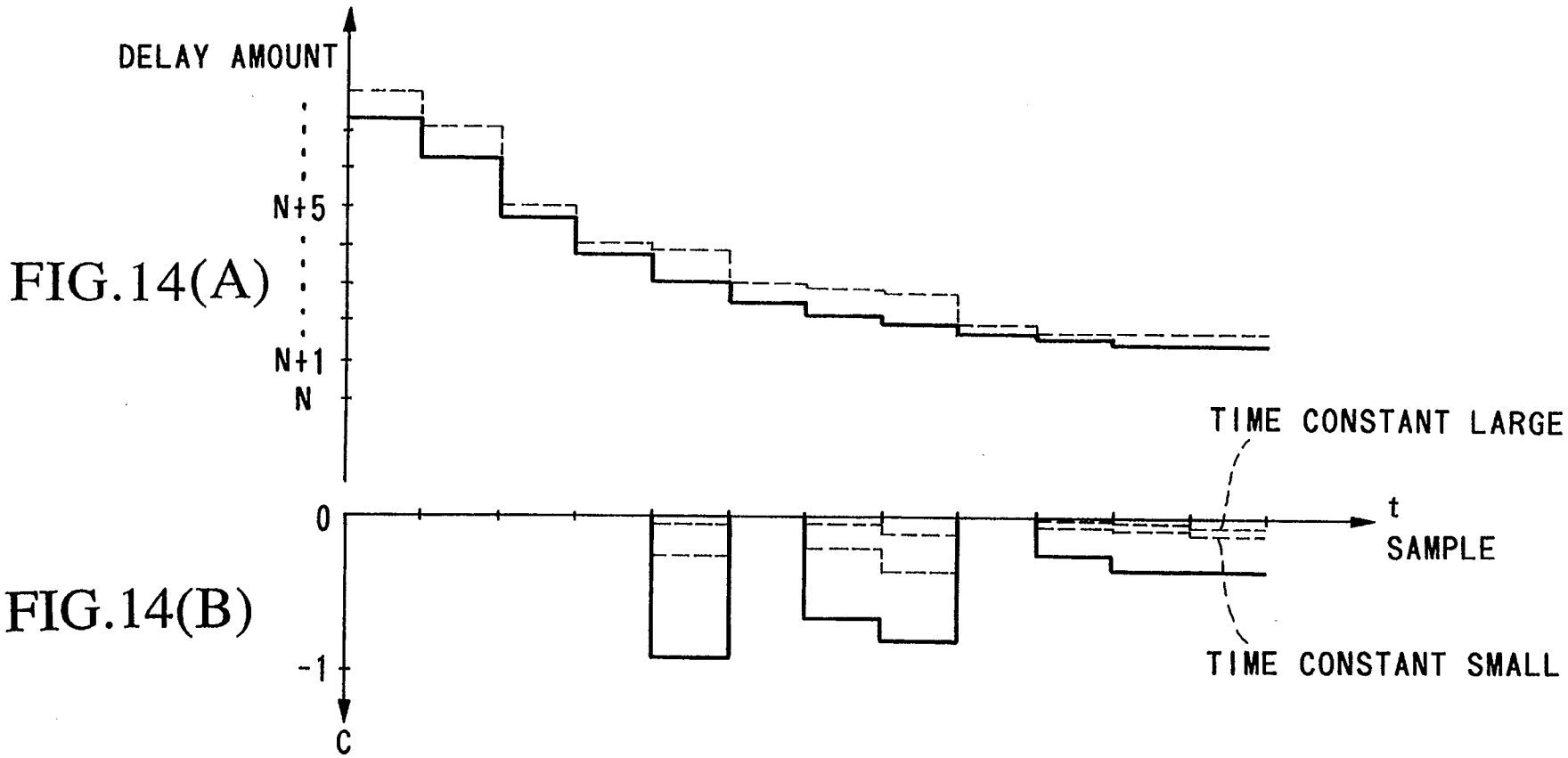

In contrast, when the integral part Di is decreased, the judgement result of step Sh3 turns to "NO" so that the processing branches to step Sh5. In step Sh5, a previous value used at a previous moment which is one sampling period prior to the current moment is set to the register 45, while the value "0" is set as the filter coefficient c and is also set to the register 53. As a result, the transfer function of the all-pass filter 4 is rewritten as follows: $H(z)=z^{-1}$. Incidentally, the above-mentioned third control method can be represented by follow-up characteristics as shown in FIGS. 13(A), 13(B), 14(A) and 14(B). FIG. 13(A) indicates a variation manner (i.e., increasing manner) of the integral part Di of the delay amount, while FIG. 13(B) indicates the corresponding variation of the filter coefficient c. On the other hand, FIG. 14(A) indicates a decreasing manner of the integral part Di, while FIG. 14(B) indicates the corresponding variation of the filter coefficient c.

(4) Fourth Control Method

If a time constant $\tau$ (where $\tau \approx 1/\alpha^{*}fs$) of the interpolation device which offers the filtering coefficient c for the all-pass filter 4 becomes too large, the following drawbacks are caused as shown in FIGS. 13(A) through 14(B). As a first drawback, the follow-up characteristic may be deteriorated. As a second drawback, if the integral part Di is changed in the next sampling period, the filter coefficient c would not match with the boundary condition, resulting that a discontinuity of the waveform may be caused. On the other hand, if the time constant $\tau$ is too small, a variation of the filter coefficient c is also enlarged, resulting that a discontinuity of the waveform may be caused.

Figure 15:
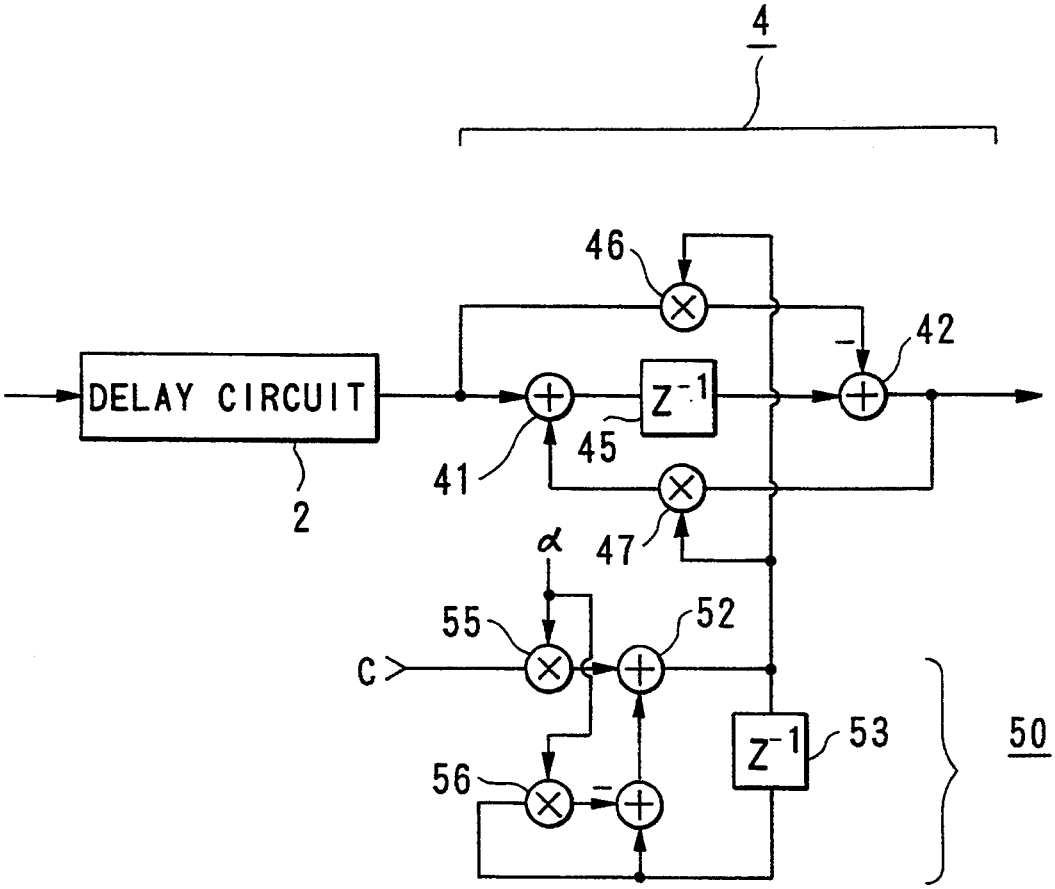
FIG. 15 is a block diagram showing an essential part of a further modified example of the DSP.

In the so-called delay-feedback-type sound source, according to the present embodiment, which produces the attenuating sound, a variation manner of the delay amount to be occurred when ascending the tone pitch is different from that of the delay amount to be occurred when descending the tone pitch. In other words, even in the same octave, the variation of the delay amount to be occurred when descending the tone pitch is larger than that of the delay amount to be occurred when ascending the tone pitch. From this fact, it is predicted that a further smooth pitch variation can be obtained by changing the time constant $\tau$ of the interpolation device 50 in response to a pitch-ascending manner or a pitch-descending manner. Under consideration of these matters, the interpolation device 50 is modified as shown in FIG. 15. In the interpolation device 50 shown in FIG. 15, the foregoing coefficient multipliers 51, 54 shown in FIG. 11 are replaced by multipliers 55, 56. A predetermined coefficient $\gamma$ is supplied to the multipliers 55 and 56 so as to alter the time constant $\tau$. As similar to the circuit configuration of the interpolation device 50 shown in FIG. 11, the circuit configuration shown in FIG. 15 in which the filter coefficient c is supplied to the all-pass filter 4 by means of the register 53 is effective to avoid the discontinuous response of the all-pass filter 4.

Figure 16:
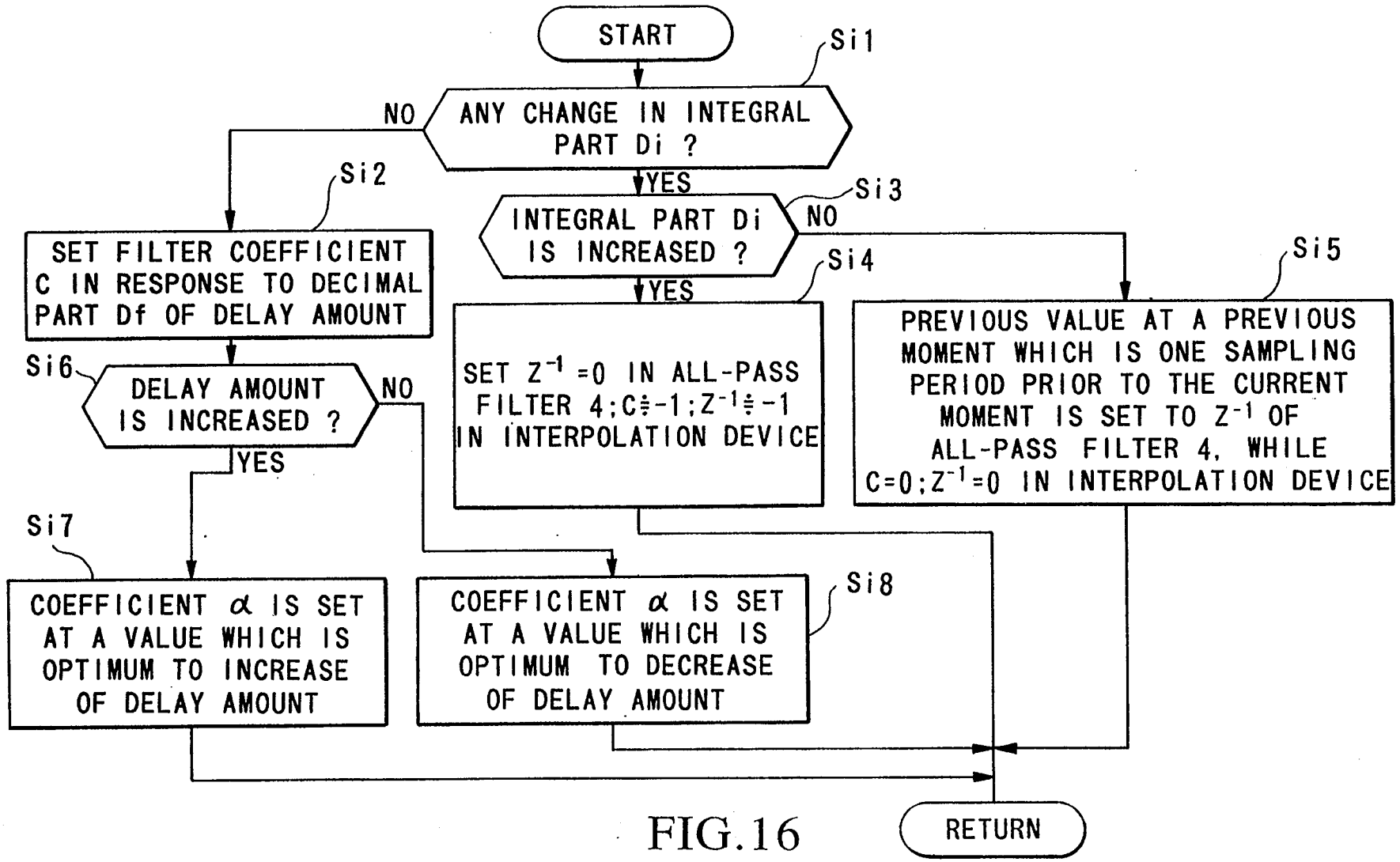
FIG. 16 is a flowchart which is used for explaining a fourth control method.
Figure 17:
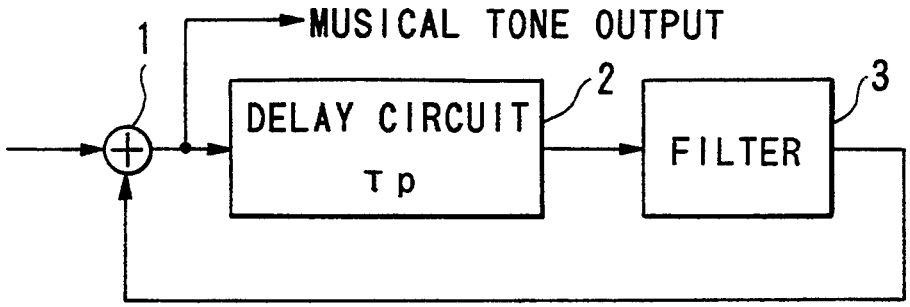
FIG.17 (PRIOR ART)
FIG. 17 is a block diagram showing an essential part of an example of the conventional musical tone synthesizing apparatus.

Next, the operation of the DSP 15 providing the interpolation device 50 of which time constant $\tau$ can be altered will be described in detail by referring to FIG. 16. In the flowchart shown in FIG. 16, steps Si1 to Si5 are identical to the foregoing steps Sh1 to Sh5 shown in FIG. 12, hence, the description thereof will be omitted. Therefore, the description will be given with respect to other steps Si6 to Si8 only.

In step Si6, it is judged whether or not the delay amount as a whole is increased. When the delay amount is increased, the judgement result of step Si6 turns to "YES", so that the processing proceeds to step Si7. In step Si7, the coefficient $\alpha$ is determined such that the interpolation device 50 can be set with the time constant $\tau$ which is optimum to an increasing event of the delay amount, and then, such coefficient $\alpha$ is supplied to the multipliers 55 and 56. On the other hand, when the delay amount is decreased, the processing branches to step Si8. In step Si8, the coefficient $\alpha$ is determined such that the interpolation device 50 can be set with the time constant $\tau$ which is optimum to a decreasing event of the delay amount, and then, such coefficient $\alpha$ is supplied to the multipliers 55 and 56. As a result, a follow-up ability of the interpolation device 50 is improved, resulting that the tone pitch can be controlled without causing a discontinuity of the waveform.

According to the above-mentioned first to fourth control methods, the filter coefficient c for the all-pass filter 4 can be controlled such that the approximately same delay amount provided in the closed-loop transfer function can be maintained before and after a boundary point at which the integral part Di of the delay amount is changed, wherein the delay amount is determined by the integral part Di and the decimal part Df. Further, the filter coefficient c is also controlled such that the approximately same amplitude of the waveform is maintained before and after the boundary point. Furthermore, since the register 45 of the all-pass filter 4 is reset, a smooth pitch control can be embodied without causing the discontinuity of the waveform.

Meanwhile, when the integral part Di of the delay amount is changed largely, the filter coefficient c is determined such that the all-pass filter 4 can be neglected apparently. In other words, the filter coefficient c is determined such that the decimal part Df of the delay amount becomes equal to "0". Moreover, the interpolation device 50 is newly introduced in order to avoid a rapid variation of the filter coefficient c. In addition, the time constant of the interpolation device 50 is altered in response to the pitch-ascending/descending event. Thus, it is possible to realize an extremely smooth pitch control. Incidentally, the filter coefficient c used for the all-pass filter 4 can be selected from a group of coefficients which are stored in a coefficient table in advance.

As described before, the present embodiment is designed to embody the pitch control in the delay-feedback-type sound source. However, the present invention is not limited to that embodiment. For example, the present invention can be applied to a flanger or another sound-effect imparting device, in which a predetermined modulation is carried out responsive to the delay time so as to impart the sound effect such as the chorus. Even in this application, it is possible to perform a smooth pitch control without causing the discontinuity in the waveform. In the foregoing embodiment, a technique of "pitch bend" is employed as the pitch control. Instead, it is possible to employ a technique of "portamento". Further, the foregoing embodiment employs the FIR digital filter as the low-pass filter 3 (see FIG. 3). However, it is possible to employ the known IIR digital filter as the low-pass filter 3. In this case, however, when altering the filter characteristic by use of the manual-operable members such as the joy stick, it is necessary to correct the variation of the delay time which is occurred due to the characteristic of the digital filter.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus comprising:

first delay means for delaying an input signal by a first delay time corresponding to an integral number of a sampling period;

second delay means for delaying an output of said first delay means by a second delay time corresponding to a decimal fraction of said sampling period, said first delay means and said second delay means being connected together in a closed loop so that an output of said second delay means is fed back to said first delay means;

delay calculating means for calculating a total delay amount applied to said closed loop, said total delay amount comprising an integral-part delay time and a decimal-part delay time, said integral-part delay time corresponding to said first delay time and said decimal-part delay time corresponding to said second delay time; and control means for controlling said integral-part delay time and said decimal-part delay time in an interrelated manner to minimize discontinuity in an output of said second delay means, whereby a musical tone signal representing a synthesized musical tone is output from said closed loop.

2. A musical tone synthesizing apparatus as defined in claim 1 wherein said second delay means is a all-pass filter which acts upon a filter coefficient supplied thereto, while said control means produces and supplies said filter coefficient to said all-pass filter such that a delay operation corresponding to said second delay time can be carried out by said all-pass filter.

3. A musical tone synthesizing apparatus as defined in claim 1 wherein said control means controls said decimal-part delay time to be approximately equal to zero when said control means controls said integral-part delay time to be increased, while said control means controls said decimal-part delay time to correspond to one sampling period when said control means controls said integral-part delay time to be decreased.

4. A musical tone synthesizing apparatus comprising:

delay means for delaying an input signal by a first delay time corresponding to a certain integral number of sampling periods;

an all-pass filter for receiving an output of said delay means and for delaying said output by a second delay time corresponding to a decimal fraction of said sampling period in response to a filter coefficient supplied thereto, said delay means and said all-pass filter being connected together in a closed loop so that an output of said all-pass filter is fed back to said delay means;

delay calculating means for calculating a whole delay amount applied to said closed loop, said whole delay amount consisting of an integral-part delay time and a decimal-part delay time, said integral-part delay time corresponding to said first delay time, while said decimal-part delay time corresponds to said second delay time;

control means for controlling said integral-part delay time which is applied to said delay means as said first delay time and said filter coefficient such that said first and second delay times are controlled in an interrelated manner to minimize a discontinuity in an output of said all-pass filter; and an interpolation means for performing an interpolation operation on said filter coefficient in response to a variation of said integral-part delay time controlled by said control means, whereby a musical tone signal representing a synthesized musical tone is obtained from said closed loop.

5. A musical tone synthesizing apparatus comprising:

excitation wave producing means for producing an excitation wave signal;

an adder for receiving said excitation wave signal;

delay means for receiving an output of said adder so as to delay it by a first delay time which corresponds to an integral number of sampling periods;

an all-pass filter, responsive to a filter coefficient supplied thereto so as to at least delay an output of said delay means by a second delay time which corresponds to a decimal fraction of said sampling period;

a low-pass filter for performing a low-pass filtering operation on an output of said all-pass filter;

a multiplier for multiplying an output of said low-pass filter by a loop gain supplied thereto, wherein said adder, said delay means, said all-pass filter, said low-pass filter and said multiplier are connected together to form a closed loop so that an output of said multiplier is fed back to said adder in which it is added to said excitation wave signal; and a delay control means for controlling said first delay time and said second delay time, respectively, in an interrelated manner to minimize discontinuity in said output of said all-pass filter, whereby a musical tone signal representing a synthesized musical tone is obtained from said output of said adder, while a tone pitch of said musical tone is continuously controlled by said control means.

6. A musical tone synthesizing apparatus comprising:

a signal producing portion for producing a signal;

a loop-circuit portion connected with said signal producing portion, said loop-circuit portion receiving said signal outputted from said signal producing portion so as to circulate it therethrough, resulting that said signal is modified in accordance with a characteristic of said loop-circuit portion while circulating through said loop-circuit portion, said loop-circuit portion further including an integral-stage delay means having an integral delay amount and a decimal-stage delay means having a decimal delay amount, said integral-stage delay means providing at least one delay means of which delay amount corresponds to an integral "1" while said decimal delay amount of said decimal-stage delay means is smaller than said delay amount of said delay means, wherein a whole delay amount of said loop-circuit portion is determined by a sum of said integral delay amount and said decimal delay amount; and delay control means for controlling said integral-stage delay means and said decimal-stage delay means such that when said whole delay amount of said loop-circuit portion is continuously increased while said integral delay amount is incremented, said decimal delay amount is firstly set substantially equal to "0", and then, said decimal delay amount is gradually increased, whereas when said integral delay amount is decremented, said decimal delay amount is first set substantially equal to "1" corresponding to one sampling period, and then, said decimal delay amount is gradually decreased.

7. A musical tone synthesizing apparatus as defined in claim 6 wherein said decimal-stage delay means is embodied by an all-pass filter.

8. A musical tone synthesizing apparatus as defined in claim 7 wherein said all-pass filter is configured by a delay circuit and an operation circuit, while said delay control means provides a coefficient generator which generates a coefficient to be supplied to said operation circuit so that said decimal delay amount is determined by said coefficient.

9. A musical tone synthesizing apparatus as defined in claim 8 wherein said delay control means further provides an interpolation circuit which interpolates said coefficient in response to a variation of said integral delay amount so as to supply an interpolated coefficient to said all-pass filter.

10. A musical tone synthesizing apparatus as defined in claim 6 wherein said decimal-stage delay means is configured by a register and an operation circuit, while said delay control means provides a coefficient generator which generates a coefficient to be supplied to said operation circuit so that said decimal delay amount is determined by said coefficient.

11. A musical tone synthesizing apparatus as defined in claim 10 wherein said delay control means controls said decimal-stage delay means such that when said integral delay amount is increased, said register is reset while said coefficient generator is controlled to generate said coefficient by which said decimal delay amount is roughly set at "0" whereas when said integral delay amount is decreased, a value which was set at said register at a preceding moment which is one sampling period prior to a current moment is set to said register again while said coefficient generator is controlled to generate said coefficient by which said decimal delay amount is set substantially equal to "1".

12. A musical tone synthesizing apparatus as defined in claim 6 further comprising an extracting means for extracting said signal circulating through said loop-circuit portion as a musical tone signal representing a musical tone to be produced.

13. A musical tone synthesizing apparatus comprising:

a signal producing portion for producing a signal;

a delay portion connected with said signal producing portion, said delay portion receiving said signal outputted from said signal producing portion so as to eventually delay it by a whole delay amount, said delay portion further including an integral-stage delay means having an integral delay amount and a decimal-stage delay means providing at least one delay means of which delay amount corresponds to an integral "1" representing one sampling period, while said decimal delay amount of said decimal-stage delay means is smaller than said delay amount of said delay means, wherein said whole delay amount of said delay portion is determined by a sum of said integral delay amount and said decimal delay amount;

delay designating means for designating said whole delay amount to be embodied by said delay portion; and delay control means for controlling said integral-stage delay means and said decimal-stage delay means such that when said whole delay amount is continuously increased while said integral delay amount is incremented, said decimal delay amount is firstly set substantially equal to "0", and then, said decimal delay amount is gradually increased, whereas when said whole delay amount is continuously decreased while said integral delay amount is decremented, said decimal delay amount is firstly set substantially equal to "1", and then, said decimal delay amount is gradually decreased.

14. A musical tone synthesizing apparatus as defined in claim 13 wherein said decimal-stage delay means is embodied by an all-pass filter.

15. A musical tone synthesizing apparatus as defined in claim 14 wherein said all-pass filter is configured by a delay circuit and an operation circuit, while said delay control means provides a coefficient generator which generates a coefficient to be supplied to said operation circuit so that said decimal delay amount is determined by said coefficient.

16. A musical tone synthesizing apparatus as defined in claim 15 wherein said delay control means further provides an interpolation circuit which interpolates said coefficient in response to a variation of said integral delay amount so as to supply an interpolated coefficient to said all-pass filter.

17. A musical tone synthesizing apparatus as defined in claim 13 wherein said decimal-stage delay means is configured by a register and an operation circuit, while said delay control means provides a coefficient generator which generates a coefficient to be supplied to said operation circuit so that said decimal delay amount is determined by said coefficient.

18. A musical tone synthesizing apparatus as defined in claim 17 wherein said delay control means controls said decimal-stage delay means such that when said integral delay amount is increased, said register is reset while said coefficient generator is controlled to generate said coefficient by which said decimal delay amount is roughly set at "0" whereas when said integral delay amount is decreased, a value which was set at said register at a preceding moment which is one sampling period prior to a current moment is set to said register again while said coefficient generator is controlled to generate said coefficient by which said decimal delay amount is set substantially equal to "1".

19. A musical tone synthesizing apparatus as defined in claim 13 further comprising an extracting means for extracting said signal circulating through said loop-circuit portion as a musical tone signal representing a musical tone to be produced.

* * * * *